US006216323B1

(12) United States Patent
Oyamada

(10) Patent No.: US 6,216,323 B1
(45) Date of Patent: Apr. 17, 2001

(54) BUCKLE ASSEMBLY

(75) Inventor: Ayaki Oyamada, Fujisawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 09/470,979

(22) Filed: Dec. 23, 1999

(30) Foreign Application Priority Data

Dec. 25, 1998 (JP) ..... 10-370542
Aug. 6, 1999 (JP) ..... 11-223647

(51) Int. Cl.[7] ..... A44B 11/26
(52) U.S. Cl. ..... 24/641; 24/640; 24/637
(58) Field of Search ..... 24/636–642, 633, 24/651

(56) References Cited

U.S. PATENT DOCUMENTS

| | | | | |
|---|---|---|---|---|
| 4,182,008 | | 1/1980 | Pouget | 24/230 |
| 4,550,474 | | 11/1985 | Doty et al. | 24/633 |
| 4,562,625 | | 1/1986 | Doty et al. | 24/640 |
| 4,703,542 | | 11/1987 | Hirata et al. | 24/641 |
| 4,733,444 | | 3/1988 | Takata | 24/641 |
| 4,802,266 | * | 2/1989 | Doty et al. | 24/641 X |
| 4,899,424 | | 2/1990 | Barnes et al. | 24/641 |
| 4,920,620 | | 5/1990 | Yamamoto et al. | 24/641 |
| 5,159,732 | * | 11/1992 | Burke | 24/641 |
| 5,271,129 | | 12/1993 | Clarke et al. | 24/641 |
| 5,584,108 | * | 12/1996 | Pleyer | 24/641 |
| 5,791,027 | | 8/1998 | Harrison et al. | 24/641 |

* cited by examiner

*Primary Examiner*—Anthony Knight
*Assistant Examiner*—Robert Sandy
(74) *Attorney, Agent, or Firm*—Evenson, McKeown, Edwards & Lenahan, P.L.L.C.

(57) ABSTRACT

A buckle assembly is provided with a latch plate for latching or unlatching a tongue plate, a holder member arranged movably in response to a movement of the latch plate, slots formed as guide paths in a buckle base, support apertures formed as a cam portion in a holder member, and an auxiliary lock member supported movably in said slots and support apertures for controlling a movement of the latch plate. In response to a movement of the holder member, the support apertures produce cam action in association with the slots such that the auxiliary member is movable between a position, in which the auxiliary lock member restricts the latch plate to a latching position, and another position, in which the auxiliary lock member restricts the latch plate to an unlatching position.

12 Claims, 17 Drawing Sheets

BUCKLE ASSEMBLY

BACKGROUND OF THE INVENTION a) Field of the Invention

This invention relates to a buckle assembly, and especially to a buckle assembly for a seat belt system arranged for a seat of a vehicle such as an automotive vehicle.

b) Description of the Related Art

Conventionally, a seat in a vehicle such as an automotive vehicle has been provided with a seal belt system. A buckle assembly for the seat belt system is generally provided with a tongue plate arranged on an end of a webbing and a buckle main body for releasably latching the tongue plate. Such buckle assemblies for seat belt systems include, for example, those disclosed in Pouget U.S. Pat. No. 4,182,008 and Clarke et al. U.S. Pat. No. 5,271,129.

A buckle main body of a buckle assembly disclosed in U.S. Pat. No. 4,182,008 is provided with a base, a slider arranged on the base such that the slider is pushed and moved by a tongue plate inserted in the base, a coil spring biasing the slider in a direction in which the tongue plate is pulled out, a latch plate movable to a tongue plate latching position when pushed by the slider, an auxiliary lock member, such as a pin, for retaining the latch plate in a latching state, a coil spring biasing the auxiliary lock member in the direction in which the tongue plate is pulled out, and a release button for releasing the latching state.

On the other hand, a buckle main body of a buckle assembly disclosed in U.S. Pat. No. 5,271,129 is provided with a base, a slider arranged on the base such that the slider is pushed and moved by a tongue plate inserted into the buckle assembly, a coil spring biasing the slider in a direction in which the tongue plate is pulled out, a latch plate movable to a tongue plate latching position when pushed by the slider, a block member slidable on the latch plate, a lock control member supported on the base, a coil spring biasing the lock control member, and a release button for releasing the latching state.

However, the buckle assembly disclosed in U.S. Pat. No. 4,182,008 involves a potential problem of occurrence of a so-called "false-latching phenomenon" in that, when performing a change-over of the latch plate between the latching position and an unlatching position by operating the release button, the auxiliary lock member may be held down by the base into a pinched state under the biasing force of the coil spring biasing the auxiliary lock member and the biasing force of the coil spring biasing the slider and may hence become stationary at an intermediate position.

The buckle assembly disclosed in U.S. Pat. No. 5,271,129 causes the block member, which plays the role of the auxiliary lock member, to move along a substantially L-shaped path, thereby making it more difficult to induce balancing of forces at an intermediate position where the latch plate may become stationary. However, this block member is also a force-bearing member. Formation of the block member with a metal to provide it with sufficient strength is accompanied by a problem of higher cost. If the block member is formed of a resin with a view to reducing its production cost, a potential problem then arises in that the reliability on its strength may be adversely affected when a high load or high impact is applied to the buckle assembly.

Buckle assemblies of another type include, for example, those disclosed in Barnes et al. U.S. Pat. No. 4,899,424 and Doty et al. U.S. Pat. No. 4,562,625.

A buckle assembly disclosed in U.S. Pat. No. 4,899,414 is provided with a base, a slider arranged on the base such that the slider is pushed and moved by a tongue plate inserted into the buckle assembly, a coil spring biasing the slider in a direction in which the tongue plate is pulled out, a latch plate movable to a tongue plate latching position when pushed by the slider, a lock member as a block member for retaining the latch plate in a latching state, a coil spring biasing the lock member in the direction in which the tongue plate is pulled out, and a release button equipped with a tilted surface for releasing the latching state and also for causing the lock member to move to a non-locking position.

Further, a buckle assembly disclosed in U.S. Pat. No. 4,562,625 is provided with a base, a slider arranged on the base such that the slider is pushed and moved by a tongue plate inserted into the buckle assembly, a lock member connected with the slider by an arm member and movable between a locking position and a non-locking position, a coil spring biasing the arm member, a latch plate movable to a latching position upon movement of the arm member and lock member when pressed by the slider, and a release button equipped with a tilted surface for causing the lock member to move to the non-locking position.

In each of the buckle assemblies disclosed in these patents, upon performing a change-over of the latch plate between the latching position and the unlatching position by operating the release button, a component of force is caused to occur in a non-locking direction (releasing direction) of the lock member by causing the lock member to move to the non-locking position with the tilted surface formed on the release button.

The buckle assemblies disclosed in of U.S. Pat. Nos. 4,899,424 and 4,562,625, however, may each develop an increase in the coefficient of friction between the tilted surface formed on the release button and the lock member or sticking between the above-described tilted surface and the lock member, for example, due to a foreign matter penetrated inside the buckle assembly. If such a situation arises, there is a potential problem that the division of force in the non-locking (release) direction by the tilted surface alone of the release button may become insufficient, leading to a potential risk that the tongue plate can be hardly released even when the release button is pressed.

SUMMARY OF THE INVENTION

The present invention has as an object the provision of a buckle assembly which can substantially eliminate the potential problem of a standstill of an auxiliary lock member at an intermediate position to reduce the occurrence of the false-latching phenomenon and which is provided with further enhanced reliability in strength.

The present invention also has as another object the provision of a buckle assembly which is provided with further enhanced reliability in the movement of a lock member to a non-locking position during a releasing operation in which the latching of a tongue plate by a latch plate is canceled to release the tongue plate from a buckle main body.

To achieve the former object, the present invention provides an buckle assembly comprising a tongue plate and a buckle main body for releasably holding said tongue plate. The buckle main body is provided with:

- a base;
- a lock control member supported on the base;
- a latch plate supported on the base movably between a latching position, in which the latch plate is in latching engagement with the tongue plate, an unlatching position, in which the latch plate is out of latching engagement with the tongue plate;

an auxiliary lock member supported on the base movably between a retaining position, in which the auxiliary lock member retains the latch plate in the latching position, and a non-retaining position, in which the auxiliary lock member does not retain the latch plate in the latching position; and a holder member held on the latch plate movably relative to the latch plate and provided with a cam portion for controlling a motion of the auxiliary lock member, said holder member being capable of assuming a first position, in which the holder member is in contact with the lock control member on a side of a leading edge of the lock control member as viewed in a direction of insertion of the tongue plate such that under biasing force of a biasing member, the latch plate is retained in the unlatching position and the auxiliary lock member is brought to the non-retaining position, and a second position, in which the holder member is located on a side of the lock control member, where the tongue plate to be inserted is positioned, such that the auxiliary lock member is brought to the retaining position.

In the buckle assembly constructed as described above, the auxiliary lock member receives a biasing force via the holder member when the tongue plate is brought into a latched state. On the other hand, upon bringing the tongue plate from the latched state into an unlatched state (released state), the holder member is first pressed and moved in a substantially horizontal direction by a pressing stroke of the release button, said pressing stroke being produced to cancel the latching by the latch plate, so that the auxiliary lock member is released from holding the latch plate. After that, the holder member changes the direction of its movement from the substantially horizontal direction to a substantially vertical direction, whereby the latch plate is caused to move to the unlatching position. At this time, the auxiliary lock member has already been released from its contact with the latch plate and owing to the cam portion of the holder member, the auxiliary lock member moves to a position where the auxiliary lock member controls the latch plate at the unlatching position. It is therefore possible to prevent the latch plate from becoming stationary at an intermediate position.

Described specifically, in the buckle assembly according to the present invention, the auxiliary lock member moves between the position, where the auxiliary lock member controls the latch plate at the latching position, and the unlatching position owing to the cam portion of the holder member. Further, the auxiliary lock member does not interfere with the latch plate except when the latch plate is in the fully locking position. It is therefore possible to avoid such a situation that the auxiliary lock member is balanced to become stationary at an intermediate position. As a consequence, the occurrence of the false-latching phenomenon can be prevented.

Further, a load which is applied to the buckle assembly can be borne by the latch plate, the auxiliary lock member and the buckle base, thereby making it possible to provide the buckle assembly with further enhanced reliability in strength.

To achieve the latter object of the present invention, the buckle assembly of the above-described construction may be constructed such that the buckle base is provided with a bottom wall and a pair of side walls extending upright from the bottom wall, and the buckle assembly is provided further with a release button for bringing the holder member from the second position to the first position when pressed and also with a control portion for controlling the release button at a leading end thereof, as viewed in a pressing direction of the release button, in a direction away from the bottom wall of the buckle base when a pressed stroke of the release button has increased.

According to the buckle assembly of the above-described construction, during a releasing operation in which the release button is pressed to cancel the latching of the tongue plate by the latch plate and hence to release the tongue plate form the buckle main body, the release button is guided by the control portion such that the holder member is caused to move to the first position. owing to this feature, even if a foreign matter or the like penetrates inside the buckle main body, it is still possible to obtain a sufficient component of force in a non-locking direction (release direction) of the holder member only by a pressing stroke of the release button produced during the releasing operation by the release button. This has made it possible to further enhance the reliability of movement of the holder member to the first position.

The control portion may be arranged in the form of slots bent or curved such that the release button can twist or prize the holder member toward the first position. More specifically, the slots may be formed in the side walls of the base, respectively, such that they are bent or curved toward upper parts of the side walls (i.e., in a direction away from the bottom wall of the base) on inner sides thereof as viewed in the pressing direction of the release button.

As another alternative, the control portion may also be formed of guide ridges bent or curved such that the release button can twist or prize the holder member toward the first position.

As a further alternative, the control portion may also be constructed such that it is bent from a point near a position, where the control portion begins to be pressed, to a point in the proximity of a position where the release button releases the holder member from the lock control member.

The arrangement of the control portion in any one of the above-described forms makes it possible to upset a balance between the release button and the holder member because a contact between the release button and the holder member becomes inconstant due to a guidance by the control portion in the course of the releasing operation by the release button. Further, the twisting or prizing of the holder member toward the first position by the release button can also bring about an advantageous effect in releasing sticking between the release button and the holder member. It is therefore possible to further enhance the reliability for the release of the tongue plate.

DETAILED DESCRIPTION OF THE PREFERRED EMBODIMENTS

Figure 1:
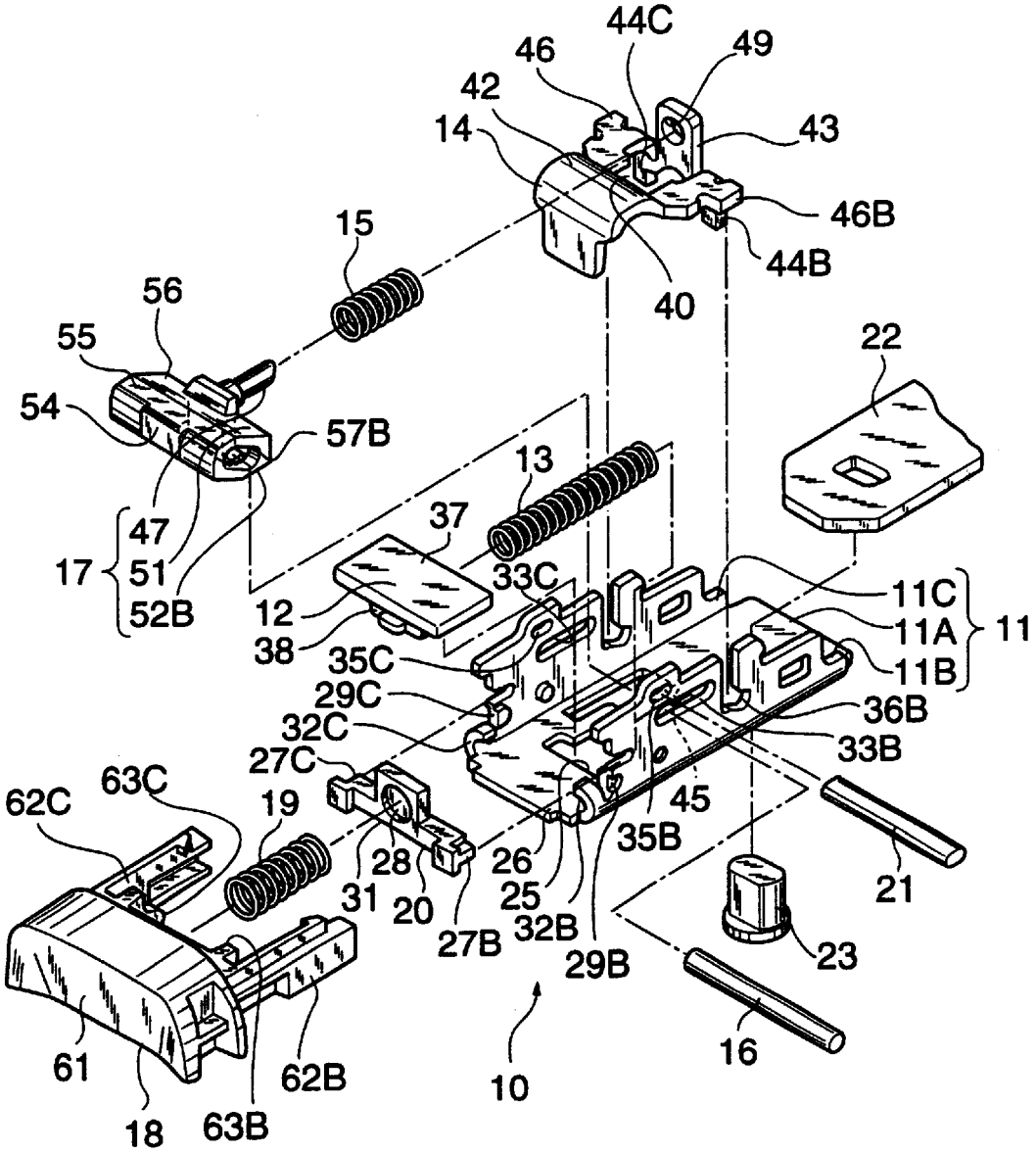
FIG. 1 is an assembling or exploded view of a buckle assembly according to a first embodiment of the present invention.

The buckle assemblies according to the first and second embodiments of the present invention will next gbe described with reference to the drawings.

As is illustrated in FIG. 1 through FIG. 11, the buckle assembly 1 according to the first embodiment of the present invention is provided with a tongue plate 5, which is arranged at an end of an unillustrated webbing, and a buckle main body 10 for releasably latching the tongue plate 5.

A tongue plate 5 is provided at an end portion thereof with a latching aperture 6 and at an opposite end portion thereof with a webbing slot 7 for connecting a webbing (not shown).

The buckle main body 10 is provided with a buckle base 11 functioning as a frame, a slider 12 movable in response to an insertion or removal of the tongue plate 5, a coil spring 13 for causing the slider 12 to move, a latch plate 14 for latching the tongue plate 5, a coil spring 15 for rocking the latch plate 14, an auxiliary lock member 16, preferably in the form of a pin, for controlling a rocking motion of the latch plate 14, a holder member 17 for supporting the coil spring 15 and also movably supporting the auxiliary lock member 16, a release button 18 for canceling latching of the tongue plate 5, a coil spring 19 biasing the release button 18 in a direction in which the tongue plate 5 is pulled out, a spring holder 20 with which the coil spring 19 is maintained in contact, and a lock control member 21 for controlling an operation of the holder member 17.

Incidentally, a plate 22 with an unillustrated webbing connected thereto like the tongue plate 5 is fixed by a rivet 23 on the buckle main body 10.

The buckle base 11 is provided with a bottom wall 11A and a pair of opposing side walls 11B,11C arranged upright at opposite sides of the bottom wall 11A, and is therefore configured substantially in a turned square U-shape as viewed in transverse cross-section. At an end portion of the bottom wall 11A as viewed in a direction in which the tongue is pulled out (the direction indicated by arrow X in FIG. 2 through FIG. 11; hereinafter called "the direction of arrow X"), a guide floor 26 is formed such that the tongue plate 5 is guided by the guide floor 26 when the tongue plate 5 is inserted or removed. In addition, the bottom wall 11A is also provided with an opening 25 for allowing the slider 12 to slide in a direction in which the tongue plate 5 is inserted and removed. At a substantially central part of an inner edge portion of the opening 25 as viewed in a direction in which the tongue 5 is inserted (the direction indicated by arrow Y in FIG. 2 through FIG. 11; hereinafter called "the direction of arrow Y"), a holding lug 45 is formed such that it holds the coil spring 13 at an end portion thereof as viewed in the direction of arrow Y.

At outer end portions of the side walls 11B,11C as viewed in the direction of arrow X, engaged portions 29B,29C are formed such that the spring holder 20 is fixedly secured. Below the engaged portions 29B,29C and adjacent the bottom wall 11A, rolled lugs 32B,32C are formed extending inward. These rolled lugs 32B,32C define a part of a mouth 53 through which the tongue plate 5 is inserted.

Through approximately central parts of the side walls 11B,11C, horizontally-elongated slots 33B,33C are formed as guide paths for supporting the auxiliary lock member 16 at opposite ends thereof movably in the directions of arrows X,Y (in other words, in a direction substantially parallel with the tongue inserting direction). Above outer edges of these slots 33B,33C as viewed in the direction of arrow X, oval apertures 35B,35C are formed to support the lock control member 21. Further, on the side of inner edges of the slots 33B,33C as viewed in the direction of arrow Y, receiving notches 36B,36C are formed in the side walls 11B,11C such that support portions 46B,46C, which are formed at opposite side walls of an inner end portion of the latch plate 14 to be described in detail subsequently herein as viewed in the direction of arrow Y, are rockably inserted and supported.

The slider 12 is configured in a substantially turned U-shape as viewed in transverse cross-section, and is constructed such that the coil spring 13 is held at an end thereof in a recess 39 formed between a substantially planner upper plate 37 and a lower portion 38 arranged on a lower wall of the upper plate 37 and configured in an L-shape as viewed in longitudinal cross-section. Incidentally, the coil spring 13 is fixed at an opposite end thereof on the holding lug 45 of the bottom wall 11A.

The slider 12 is slidably supported with the lower portion 38 thereof loose-fitted in the opening 25 of the buckle base 11. When the tongue plate 5 is inserted into the buckle main body 10, the slider 12 is pressed by the leading end of the tongue plate 5 and is hence caused to slide in the direction of arrow Y against biasing force of the coil spring 13, whereby the slider 12 presses legs 44B,44C, which are arranged on lower ends of both side portions of the latch plate 14 to be described in detail subsequently herein, so that the latch plate 14 is caused to pivot counterclockwise (in a direction in which the latch plate 14 latches the tongue plate 5). When the tongue plate 5 is pulled out, on the other hand, the slider 12 is caused to return in the direction of arrow X under the biasing force of the coil spring 13.

Through an approximately central part of the latch plate 14, an opening 40 is formed such that the holder member 17 to be described in detail subsequently herein is partly inserted there. At an outer end portion of the latch plate 14 as viewed in the direction of arrow X, a latch portion 41—which is to be inserted into the latching aperture 6 of the tongue plate 5 for the latching of the tongue plate 5 when the tongue plate 5 is inserted into the buckle main body 10—is formed extending downward. Formed between the latch portion 41 and the opening 40 is a support surface 42 which can be brought into contact with the auxiliary lock member 16 to be described in detail subsequently herein. On the opposite side walls of the inner end portion of the latch plate 14 as viewed in the direction of arrow Y, the support portions 46A,46B are arranged extending from the opposite side walls. These support portions 46A,46B are rockably (pivotally) supported in the receiving notches 36B,36C of the side walls 11B,11C. Described specifically, the latch plate 14 rocks about the support portions 46B,46C as fulcrums and moves to the latching position, in which the latch plate 14 latches the tongue plate 5, or to an unlatching position, in which the latching of the tongue plate 5 is cancelled. On the opposite side walls of an inner end portion of the latch plate 14 as viewed in the direction of arrow Y, the legs 44B,44C are arranged extending downward. The slider 12 can be brought into contact with these legs 44B, 44C as mentioned above.

The holder member 17 is provided with a main part 51, side walls 52B,52C, which are formed on opposite side walls of the main part 51, and a shaft 47 formed at a substantially central part of an outer end portion of the main part 51 as viewed in the direction of arrow Y.

The main part 51 is formed of a curved surface 54 arranged on an outer side as viewed in the direction of arrow X, a planar surface 55 formed in continuation with an upper part of the curved surface 54, a tilted surface 56 arranged in continuation with the planar surface 55, and a protuberance 58 extending downward from a substantially central part of the tilted surface 56.

The protuberance 58 is inserted in the opening 40 of the latch plate 14, and at end walls thereof as viewed in a transverse direction, is provided with claws 58B,58C which project outward in the transverse direction. Both of these claws 58B,58C are maintained in slidable engagement with the lower wall of the latch plate 14 at locations adjacent the opening 40. Namely, the holder member 17 is arranged such that the latch plate 14 is embraced by both of the claws 58B,58C.

Incidentally, the main part 51 is open at a surface (a lower surface in FIG. 1) located opposite the planar surface 55, and is constructed such that the auxiliary lock member 16 inserted in the support apertures 57B,57C to be described in detail subsequently herein are exposed through the lower surface.

Through substantially central parts of the side walls 52B,52C, the support apertures 57B,57C are opened as cam portions in the form of elongated apertures tilted relative to the planar surface 55. Through these support apertures 57B,57C, the auxiliary lock member 16 is movably inserted. Opposite end portions of the auxiliary lock member 16 which extends through the support apertures 57B,57C are inserted in the slots 33B,33C movably in the directions of arrows X,Y.

In a stage where the tongue plate 5 has not been inserted yet (see FIG. 2 and FIG. 11), the holder member 17 is biased in the direction of arrow X by the coil spring 15 and is maintained in contact with the lock control member 21 to be described in detail subsequently herein. The auxiliary lock member 16 is therefore located on the side of the inner edges of the support apertures 57B,57C and the slots 33B,33C as viewed in the direction of arrow Y. At this time, the support apertures 57B,57C are arranged such that they are oblique relative to the slots 33B,33C, in other words, they intersect at a predetermined angle the slots 33B,33C, respectively.

The shaft 47 is formed such that it has smaller diameter at a free end thereof, which is an inner end as viewed in the direction of arrow Y, than at a basal end thereof which is an outer end as viewed in the direction of arrow X. The coil spring 15 is loose-fitted on the shaft 47 so that owing to the arrangement of the shaft 47, the coil spring 15 is prevented from being bent or broken when it undergoes expansion and contraction. The small-diameter portion of the shaft 47 is dimensioned such that the small-diameter portion of the shaft 47 can freely extend back and forth through an opening 49 formed in an abutting portion 43 of the latch plate 14. On the other hand, the large-diameter portion of the shaft 47 is dimensioned greater than the diameter of the opening 49.

As has been described above, the shaft 47 freely extends back and forth through the opening 49 of the latch plate 14, and the claws 58B,58C are in slidable engagement with the latch plate 14 in such a way that the claws 58B,58C embrace the latch plate 14 therein. In response to a movement of the latch plate 14, the holder member 17 can therefore, for example, slide on the latch plate 14 in a direction substantially parallel with the tongue plate inserting direction in the state of FIG. 5 in which the latch plate 14 is in the locking position.

The lock control member 21 is constructed of a pin-like member having an oval shape in transverse cross-section, and is inserted and supported in the oval apertures 35B,35C formed in the side walls 11B,11C. Incidentally, this lock control member 21 is arranged at a position where the holder member 17 can be brought into contact with the lock control member 21.

The spring holder 20 is provided at transversely opposite ends thereof with engaging portions 27B,27C, which are brought into engagement with the engaged portions 29B, 29C formed on the side walls 11B,11C, respectively. On a substantially central part of the spring holder 20, a recessed spring seat 28 is formed to fixedly hold the coil spring 19 at an inner end portion thereof as viewed in the direction of arrow Y. Formed on a lower part of the spring holder 20 is an upper wall forming portion 31 as an upper wall of the mouth 53. The engaging portions 27B,27C are maintained in fixed engagement with the engaged portions 29B,29C, so that the spring holder 20 is fixedly secured on the buckle base 11. As a result of this fixed securement, the mouth 53 is formed by the upper wall forming portion 31, the rolled lugs 32B,32C and the guide floor 26.

The release button 18 is provided with an operating portion 61, which can be pressed by a user, and arms 62B,62C arranged on opposite sides of the operating portion 61 such that the arms 62B,62C extend out horizontally in the direction of arrow Y. This release button 18 moves in the directions of arrows X,Y with the arms 62B,62C slidably supported by the side walls 11B,11C. Further, on an inner end wall of the operating portion 61 of the release button 18 as viewed in the direction of arrow Y, fingers 63B,63C are formed such that they can be brought into contact with the curved surface 54 of the holder member 17.

A recessed spring seat 64 for holding the coil spring 19 is formed on the inner end wall of the operating portion 61 at a substantially central part thereof. As the coil spring 19.held by the recessed spring seat 64 is fixedly held at the opposite end thereof by the recessed spring seat 28, the release button 18 is biased normally in the direction of arrow X by the coil spring 19.

The buckle main body 10 constructed as described above is enclosed in an unillustrated cover.

A description will next be made about a specific operation of the buckle assembly according to the first embodiment.

Figure 2:
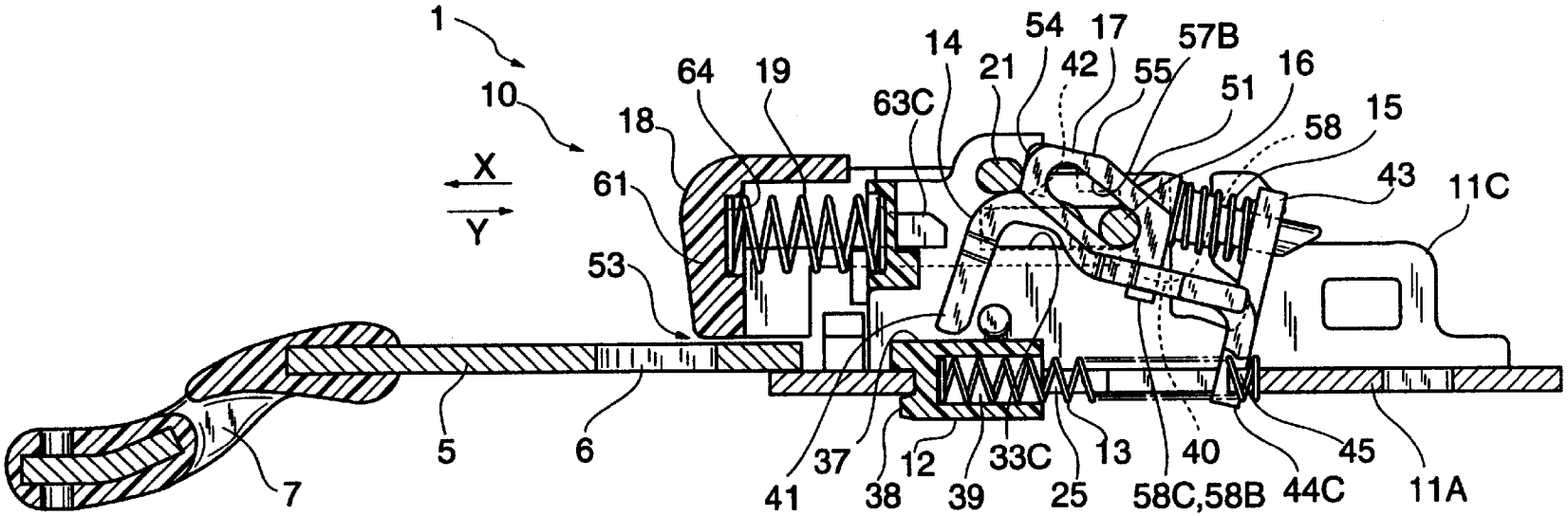
FIG. 2 is a cross-sectional view of the buckle assembly according to the first embodiment in a stage of an operation.
Figure 11:
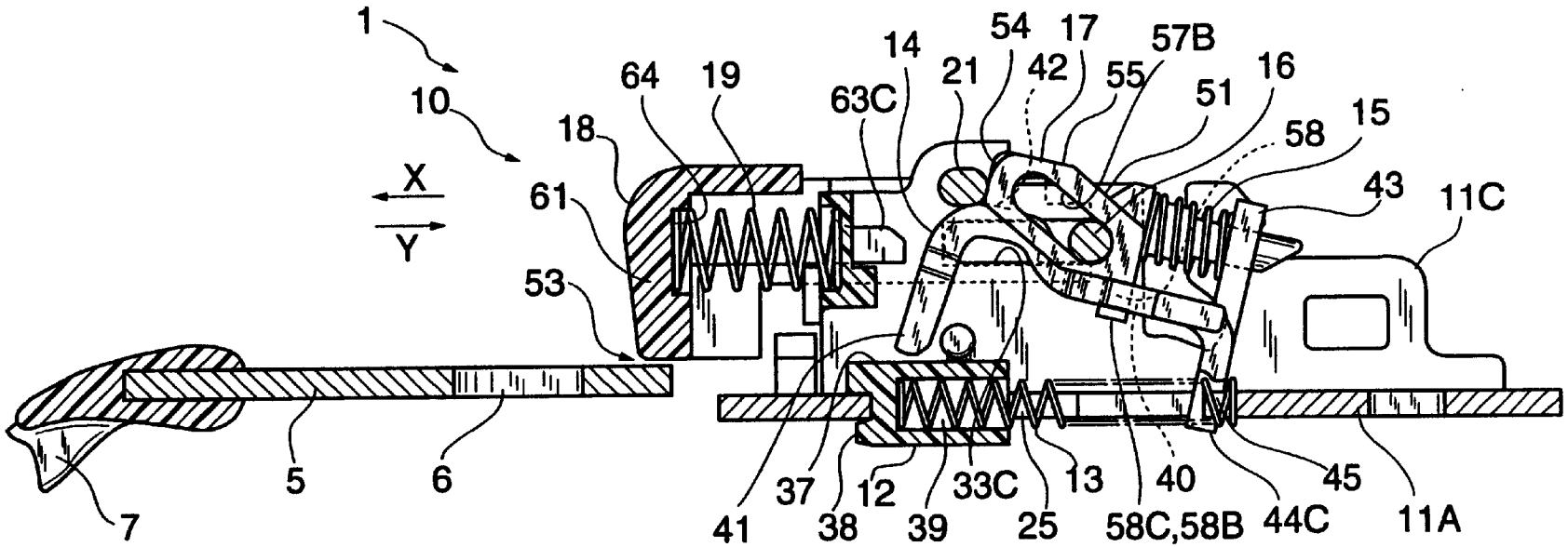
FIG. 11 is a cross-sectional view of the buckle assembly according to the first embodiment in a still further of the operation.
Figure 12:
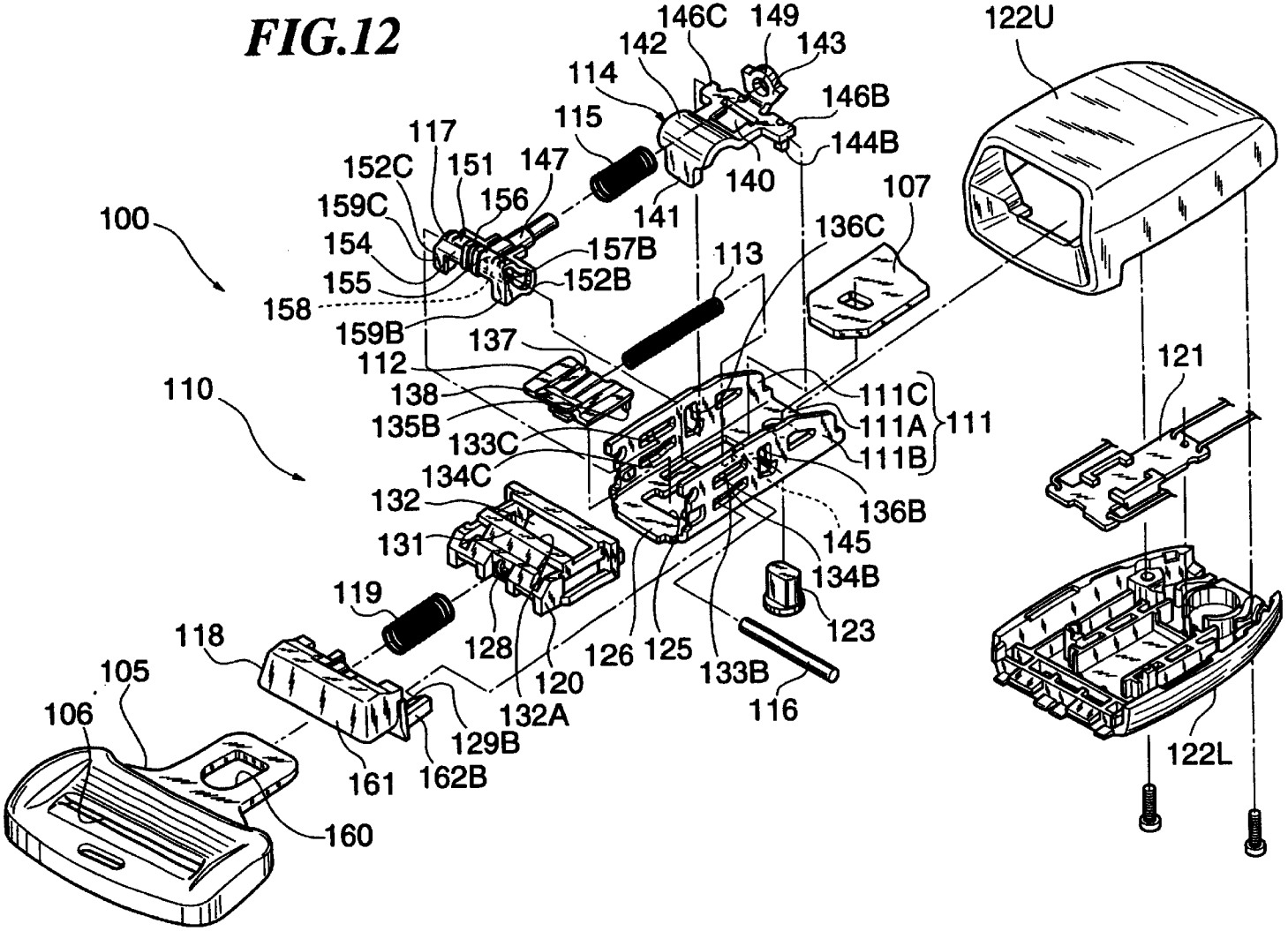
FIG. 12 is an assembling or exploded view of a buckle assembly according to a second embodiment of the present invention.

When the tongue plate 5 has not been inserted yet in the buckle main body 10, the slider 12 is placed in the state that, as is illustrated in FIG. 2 and FIG. 11, the slider 12 is in contact with the inner edge portion, as viewed in the direction of arrow X, of the opening 25 of the bottom wall 11A of the buckle base 11 by the biasing force of the coil spring 13.

The holder member 17 is biased in an upper left direction by the coil spring 15, whereby the support apertures 57B, 57C in the holder member 17 and the slots 33B,33C in the side walls 11B,11C are arranged at a certain angle therebetween, respectively.

Further, the auxiliary lock member 16 is located at the inner edges of the support apertures 57B,57C as viewed in the direction of arrow Y and also at the inner edges of the slots 33B,33C (in the non-locking position). At this time, the latch plate 14 is allowed to retain under the biasing force of the coil spring 15 the state that the latch portion 41 is located in an upper position. Accordingly, the auxiliary lock member 16 is out of contact with the latch plate 14.

Figure 3:
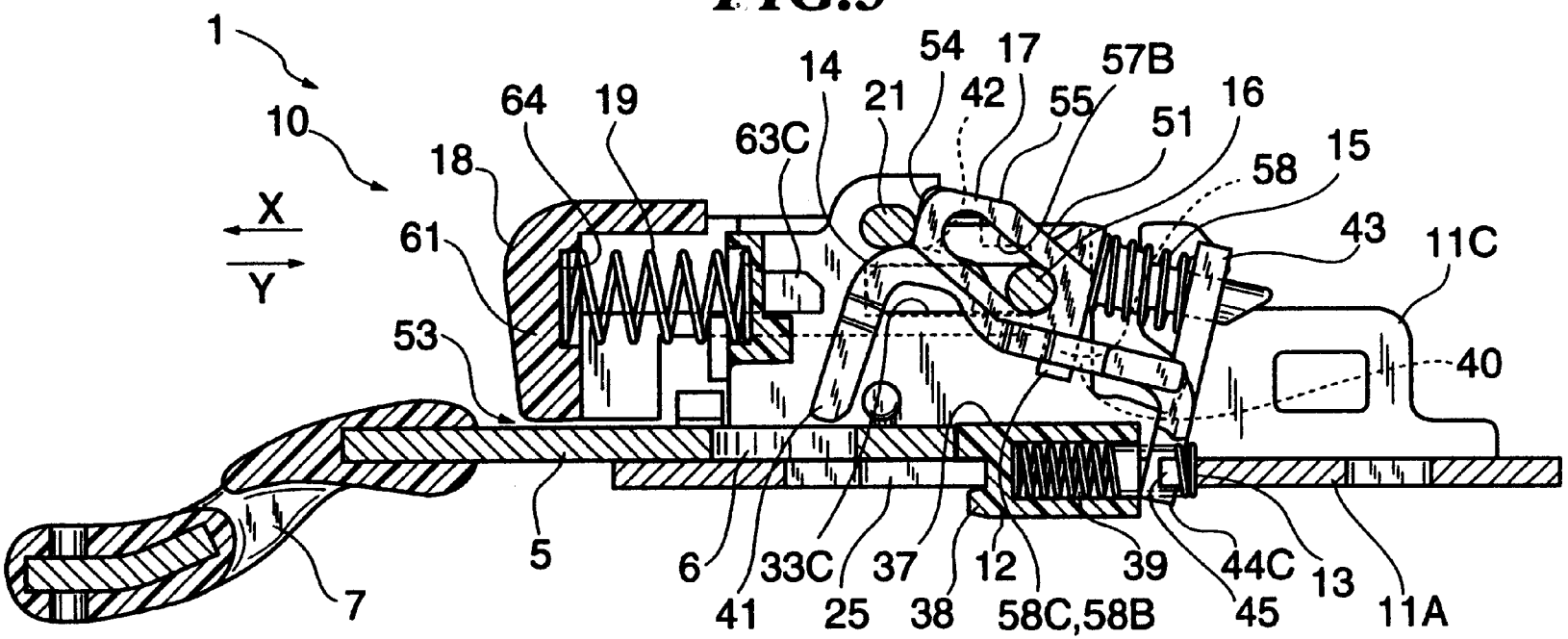
FIG. 3 is a cross-sectional view of the buckle assembly according to the first embodiment in another of the operation.

To latch the tongue plate 5 in the buckle main body 10, the tongue plate 5 is firstly inserted into the buckle main body 10 through the mouth 53 as illustrated in FIG. 2 and FIG. 3. At this time, the leading end of the tongue plate 5 causes the slider 12 to move in the direction of arrow Y so that the coil spring 13 is compressed. When the slider 12 comes into contact with the legs 44B,44C of the latch plate 14, the latch plate 14 begins to pivot toward the locking position (in a counterclockwise direction shown in the drawings) about the support portions 46B,46C as fulcrums.

Figure 4:
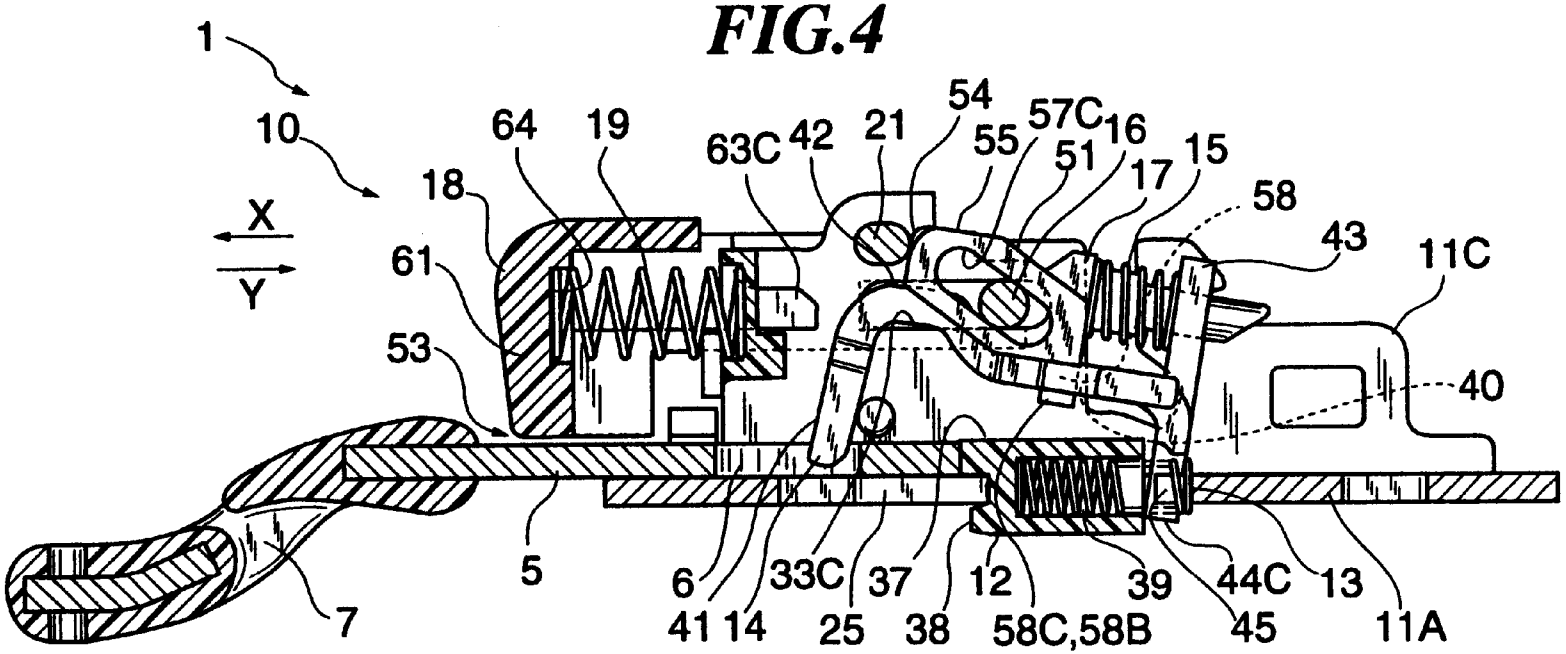
FIG. 4 is a cross-sectional view of the buckle assembly according to the first embodiment in a further of the operation.

Concurrently with the above motion, the holder member 17 begins to move in response to the pivotal motion of the latch plate 14 while compressing the coil spring 15 with the curved surface 54 maintained in contact with the lock control member 21. Described specifically, the holder member 17 moves downward in a substantially vertical direction together with the latch plate 14 while being prevented from moving approximately in the direction of arrow X by the lock control member 21. By this movement of the holder member 17, the auxiliary lock member 16 is pressed by upper edges of the support apertures 57B,57C as shown in FIG. 4, so that the auxiliary lock member 16 begins to move toward the retaining position in the direction of arrow X in the slots 33B,33C of the side walls 11B,11C. Namely, the auxiliary lock member 16 undergoes the above-described movement by the cam action of the support apertures 57B,57C and that of the slots 33B,33C.

Figure 5:
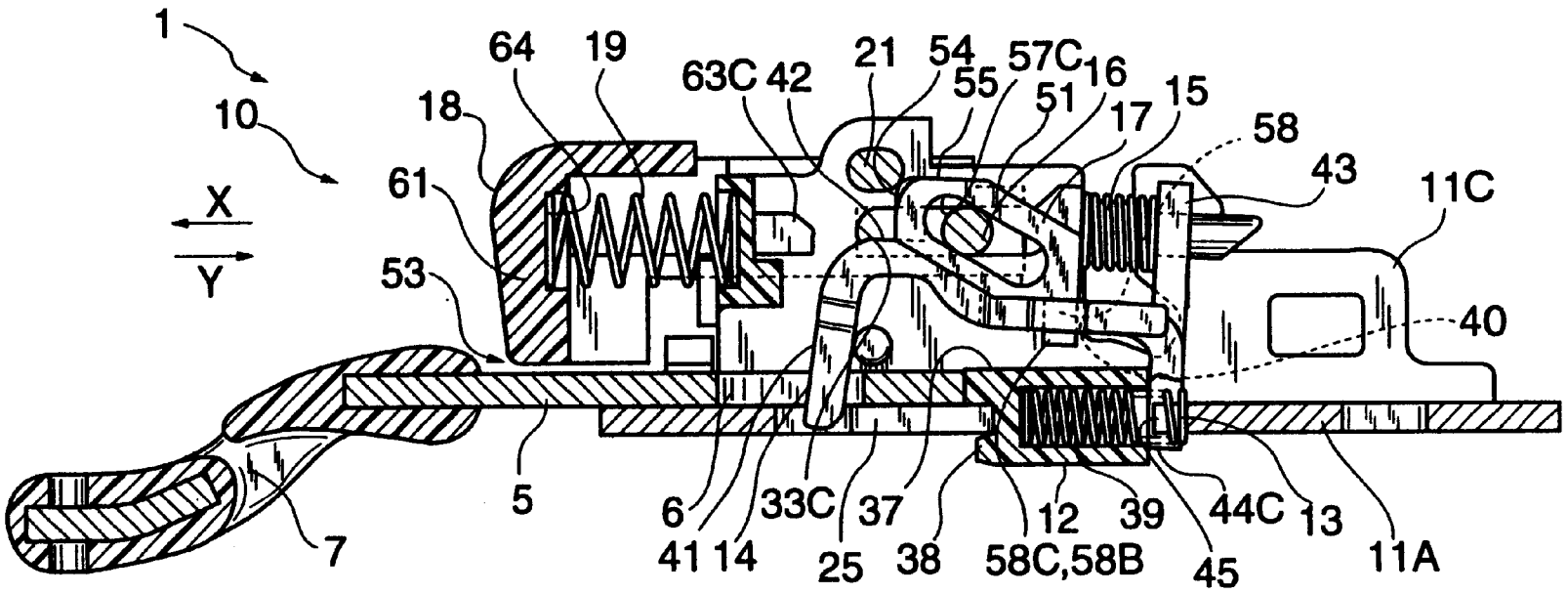
FIG. 5 is a cross-sectional view of the buckle assembly according to the first embodiment in a still further of the operation.

When the tongue plate 5 is inserted, the latch plate 14 and the holder member 17 move further as illustrated in FIG. 5. The curved surface 54 of the holder member 17 is then caused to move beyond the lock control member 21, whereby the holder member 17 disengages toward a point below the lock control member 21 (toward a side on which the inserted tongue plate 5 is located). As a result, the holder member 17 becomes movable substantially in the direction of arrow X.

Figure 6:
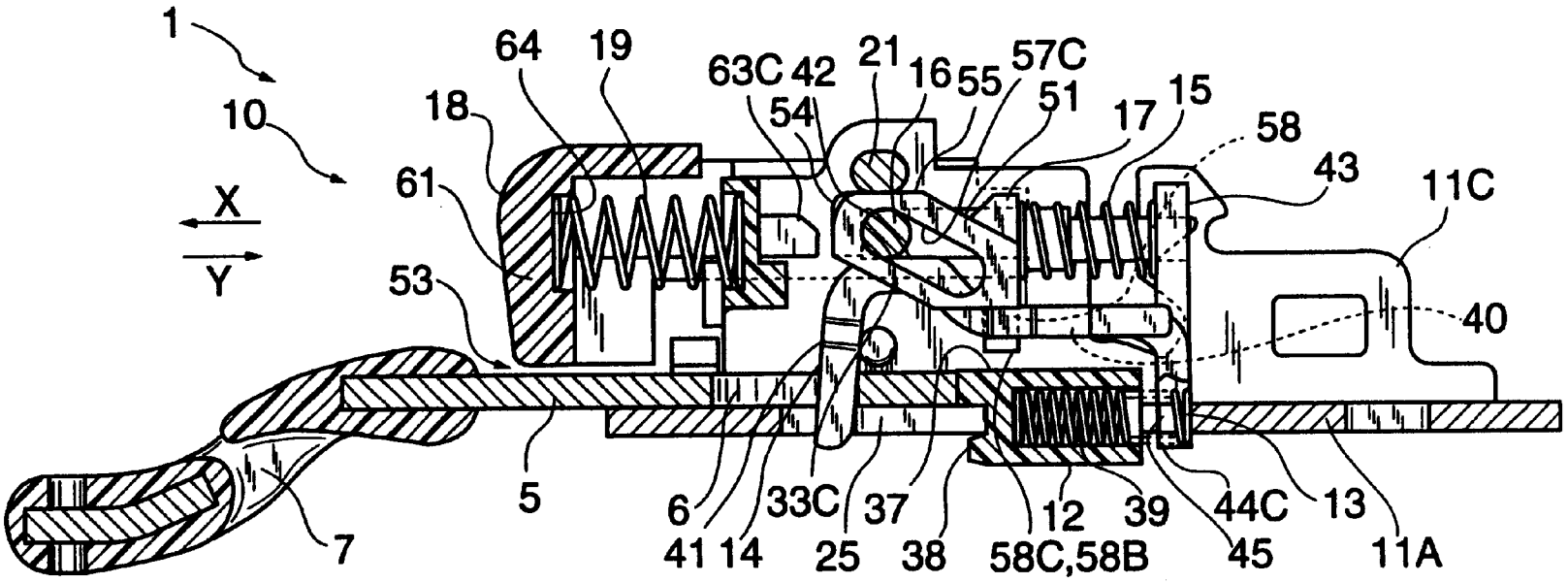
FIG. 6 is a cross-sectional view of the buckle assembly according to the first embodiment in a still further of the operation.

Subsequent to this motion, the planar surface 55 of the holder member 17 comes into contact with the lower surface of the lock control member 21 as illustrated in FIG. 6, and by the biasing force of the coil spring 15, the holder member 17 changes the direction of its movement substantially in the direction of arrow X. As a consequence, the auxiliary lock member 16 moves at a stretch to the outer edges of the support apertures 57B,57C of the holder member 17 as viewed in the direction of arrow X and also to the outer edges of the slots 33B,33C as viewed in the direction of arrow X, that is, to the retaining position, so that the auxiliary lock member 16 is brought into contact with the support surface 42 of the latch plate 14. By this time, the latch plate 14 has moved to the latching position and has completed the latching of the tongue plate 5. It is therefore possible to prevent the auxiliary lock member 16 from being held between the latch plate 14 and the slots 33B,33C of the side walls 11B,11C of the buckle base 11.

Since the auxiliary lock member 16 is allowed to come into contact with the support surface 42 of the latch plate 14 only when the latch plate 14 is in the latching position, it is possible to prevent the auxiliary lock member 16 from attaining a balance and becoming stationary at an intermediate position.

In this state, a force applied toward the unlatching position of the latch plate 14 (in the releasing direction) is borne by the support surface 42 of the latch plate 14, the auxiliary lock member 16, and the slots 33B,33C of the side walls 11B,11C. The force is therefore divided, thereby making it possible to further enhance the reliability for strength.

Figure 7:
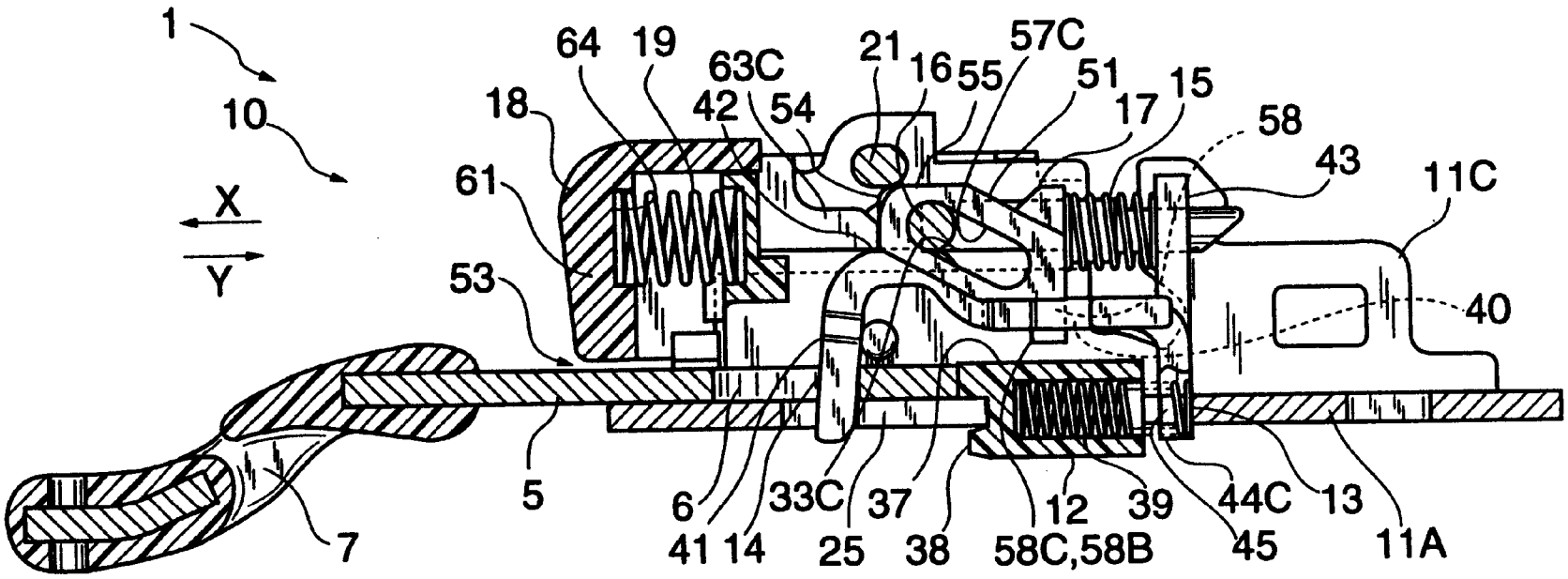
FIG. 7 is a cross-sectional view of the buckle assembly according to the first embodiment in a still further of the operation.

Next, upon pulling the tongue plate 5 out of the buckle main body 10, the release button is pressed in the direction of arrow Y. The fingers 63B,63C of the release button 18 then come into contact with the curved surface 54 of the holder member 17 as shown in FIG. 7.

Figure 8:
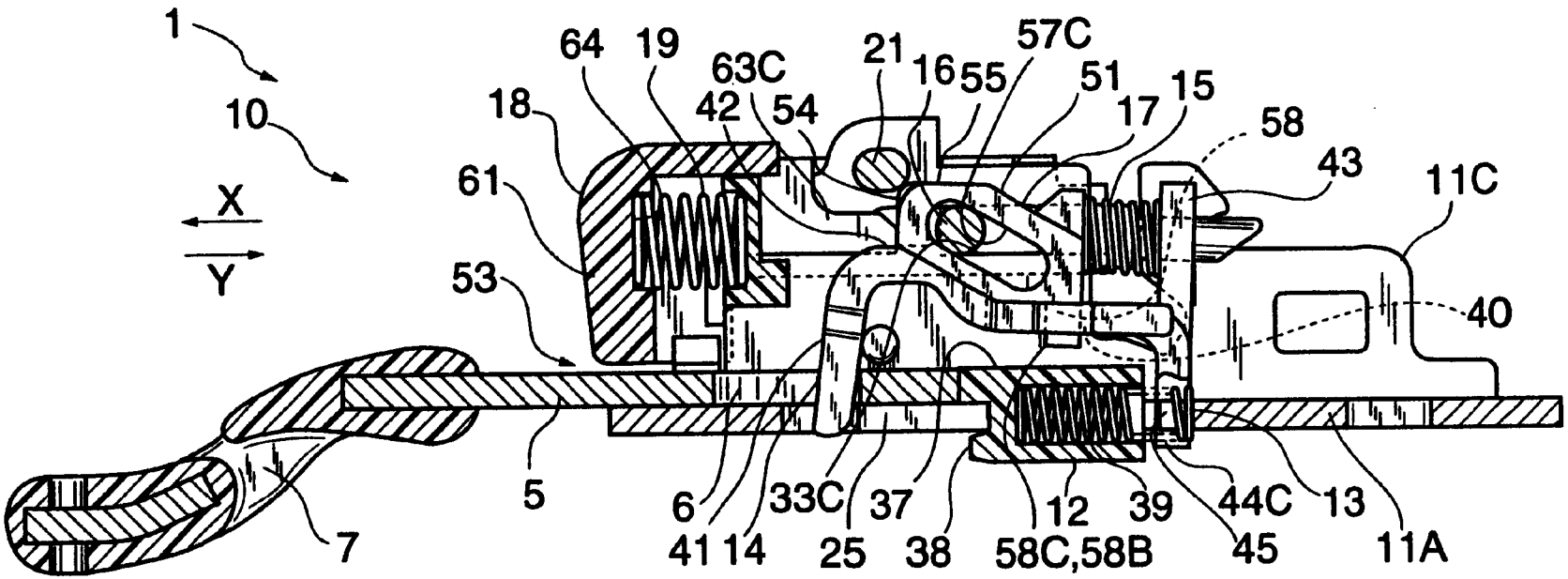
FIG. 8 is a cross-sectional view of the buckle assembly according to the first embodiment in a still further of the operation.

When the release button 18 is pressed further, the holder member 17 begins to move in the direction of arrow Y (in a substantially horizontal direction) as depicted in FIG. 8. Accordingly, the auxiliary lock member 16 is pressed via the support apertures 57B,57C of the holder member 17 and begins to move in the direction of arrow Y, whereby the contact between the auxiliary lock member 16 and the support surface 42 of the latch plate 14 is canceled. At this time point, the outer edge, as viewed in the direction of arrow X, of the planar surface 55 of the holder member 17 is still located on the lower surface of the lock control member 21, so that the latch plate 14 is held by the holder member 17 and remains in the latching position. Further, the holder member 17 is also prevented from moving in a substantially vertical direction.

Figure 9:
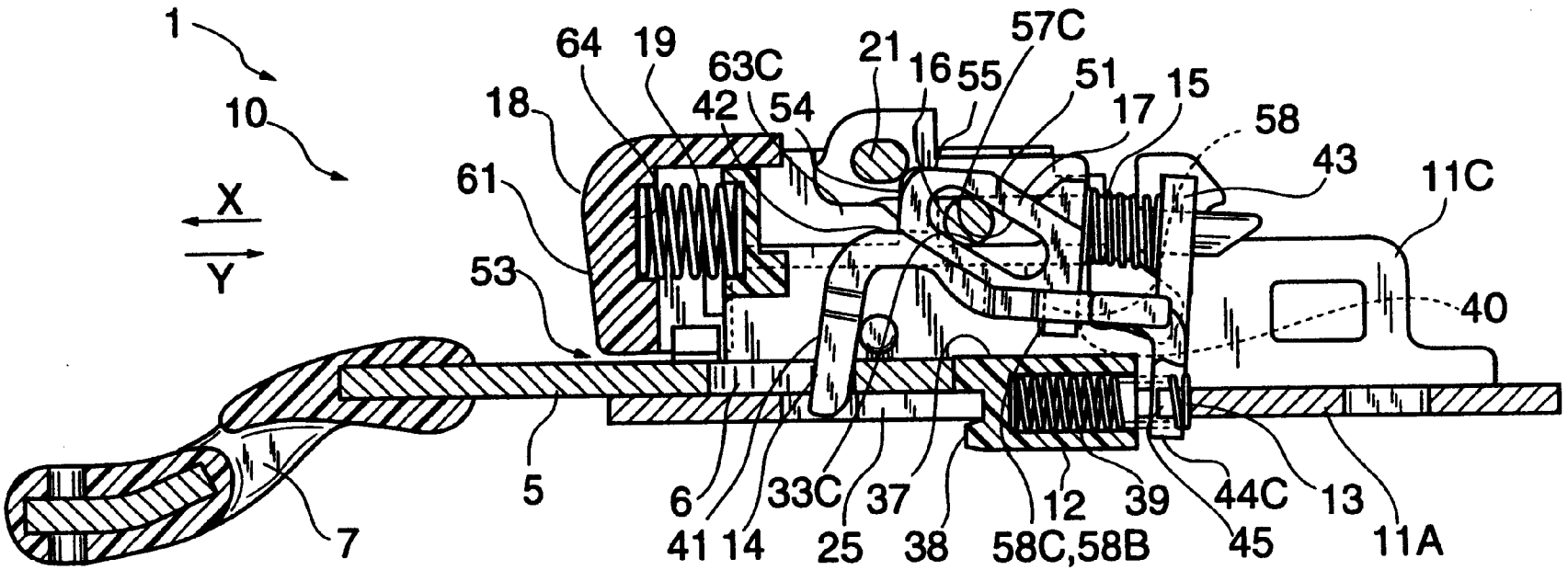
FIG. 9 is a cross-sectional view of the buckle assembly according to the first embodiment in a still further of the operation.
Figure 10:
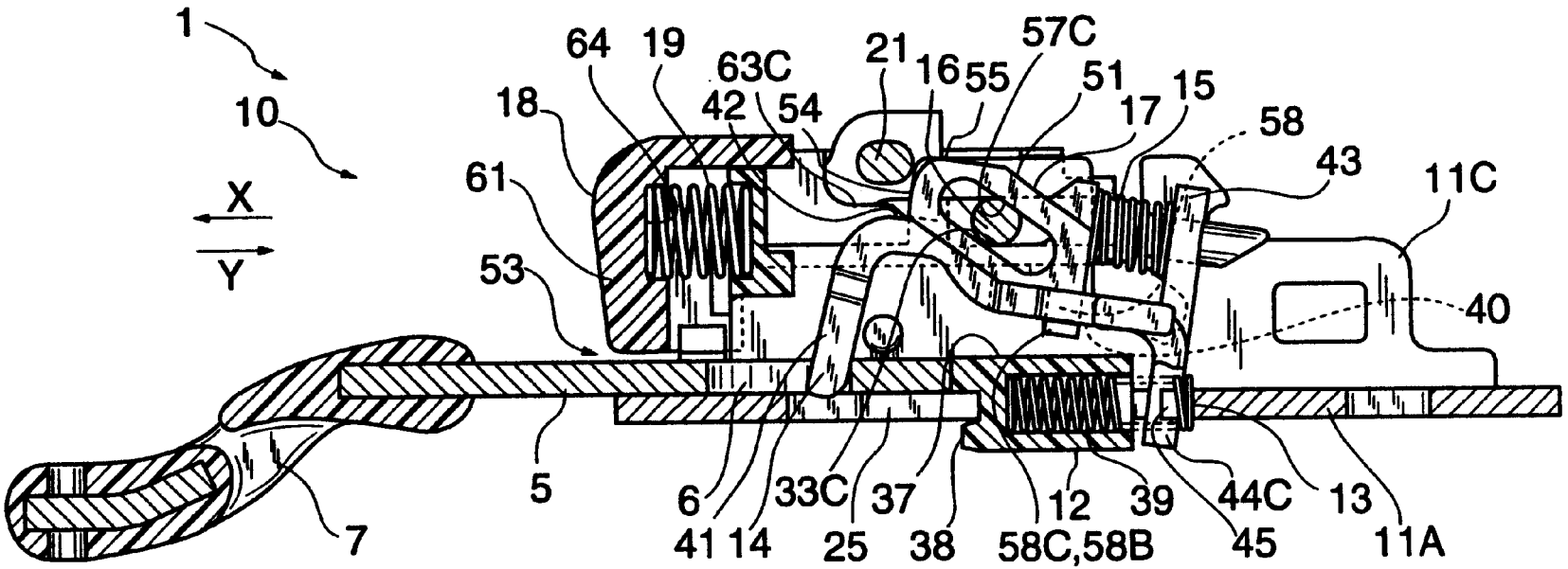
FIG. 10 is a cross-sectional view of the buckle assembly according to the first embodiment in a still further of the operation.

When the release button 18 is pressed still further, the outer edge, as viewed in the direction of arrow X, of the planar surface 55 of the holder member 17 is caused to move beyond the lock control member 21 and disengages from the lower surface of the lock control member 21 as shown in FIG. 9. As a result, it becomes possible for the holder member 17 to move in a substantially vertical direction. In continuation with this, the holder member 17, as is illustrated in FIG. 10, moves upward in a substantially vertical direction at a stretch by the biasing forces of the coil springs 15,13 with the curved surface 54 maintained in contact with the lock control member 21.

Concurrently with this upward movement of the holder member 17 in the substantially vertical direction, the latch plate 14 pivots toward the unlatching position (in a clockwise direction) by the biasing force of the coil spring 15 about the support portions 46B,46C as fulcrums and moves to the unlatching position, so that the latching of the tongue plate 5 is canceled as shown in FIG. 11.

At the same time, the auxiliary lock member 16 is pressed by the lower edges of the support apertures 57B,57C of the holder member 17 and moves in the direction of arrow Y at a stretch in the slots 33B,33C of the side walls 11B,11C. Described specifically, the auxiliary lock member 16 is caused to move by the cam action of the support apertures 57B,57C and that of the slots 33B,33C. At this time, the auxiliary lock member 16 is supported only in the support apertures 57B,57C and the slots 33B,33C and is out of contact with the latch plate 14. The auxiliary lock member 16 therefore moves to a non-retaining position without stopping at an intermediate position.

As has been described above, the auxiliary lock member 16 does not interfere with the latch plate 14 except when the latch plate 14 is exactly in the locking position, and when the latch plate 14 is about to move toward the unlatching position, the auxiliary lock member 16 moves at a stretch by the above-mentioned cam actions. Upon performing a change-over of the latch plate 14 between the latching position and the unlatching position, the auxiliary lock member 16 is therefore held and pinched by the biasing force of the coil spring 15, which urges the auxiliary lock member 16, and the biasing force of the coil spring 13, which urges the slider 12, thereby making it possible to prevent the auxiliary lock member 16 from attaining a balance and becoming stationary at an intermediate position.

In the first embodiment described above, the support apertures 57B,57C of the holder member 17 were formed as elongated apertures. It is however to be noted that the support apertures 57B,57C are not limited to such a shape and can be apertures of a different shape insofar as cam action can be produced.

A description will next be made about the second embodiment of the present invention.

As is illustrated in FIG. 12 through FIG. 17, the buckle assembly 100 according to the second embodiment of the present invention is provided with a tongue plate 105, through a webbing slot 106 of which an unillustrated webbing extends, and a buckle main body 110 for releasably latching the tongue plate 105.

The tongue plate 105 is provided at an end portion thereof with a latching aperture 160 and at an opposite end portion thereof with the webbing slot 107 for permitting therethrough an insertion of the webbing (not shown).

The buckle main body 110 is provided with a buckle base 111 functioning as a frame, a slider 112 movable in response to an insertion or removal of the tongue plate 105, a coil spring 113 for causing the slider 112 to move, a latch plate 114 for latching the tongue plate 105, a coil spring 115 for rocking the latch plate 114, a lock pin 116 for controlling a rocking motion of the latch plate 114, a holder member 117 for supporting the coil spring 115 and also movably supporting the lock pin 116, a release button 118 for canceling latching of the tongue plate 105, a coil spring 119 biasing the release button 118 in a direction in which the tongue plate 105 is pulled out, a spring holder 120 with which the coil spring 119 is maintained in contact, a switch 121 for detecting a latched or unlatched state of the tongue plate 105, and a lower cover 122L and an upper cover 122U between which the above-described elements are accommodated.

In the second embodiment, the lock member comprises the holder member 117 and the lock pin 116.

Incidentally, a stay 107 is fixed at a free end thereof on the buckle main body 110 by a rivet 123.

The buckle base ill is provided with a bottom wall 111A and a pair of opposing side walls 111B,111C arranged upright at opposite sides of the bottom wall 11A, and is therefore configured substantially in a turned square U-shape as viewed in transverse cross-section. At an end portion of the bottom wall 111A as viewed in a direction in which the tongue plate is pulled out (the leftward direction in FIG. 12 through FIG. 16; this direction will hereinafter be called "leftward"), a guide floor 126 is formed such that the tongue plate 105 is guided by the guide floor 126 when the tongue plate 105 is inserted or removed. In addition, the bottom wall 111A is also provided with an opening 125 for allowing the slider 112 to slide in a direction in which the tongue plate 105 is inserted and removed. At a substantially central part of an inner edge portion of the opening 125 as viewed in a direction in which the tongue plate 105 is inserted (the rightward direction in FIG. 12 through FIG. 16; this direction will hereinafter be called "rightward"), a holding lug 145 is formed such that it holds the coil spring 113 at a right end portion thereof.

Through approximately central parts of the side walls 111B,111C, horizontally-elongated slots 133B,133C are formed such that the lock pin 116 is supported at opposite ends thereof movably leftward and rightward. Below the slots 133B,133C, cranked slots 134B,134C are formed as a control portion for movably supporting beads 129A,129B of the release button 118 to be described subsequently herein. Each of these cranked slots 134B,134C has such a substantially crank shape that it is bent upward on a right side of an approximately central part in the horizontal direction and that it again extends in a substantially horizontal direction. In other words, each of the cranked slots 134B,134C is formed such that it is bent from a position where the release button 118 presses the holder member 117 to a point in the proximity of a position at which the holder member 117 is released from the lock control member 131 to be described in detail subsequently herein.

Further, on the right sides of the slots 133B,133C, receiving notches 136B,136C are formed such that support portions 146B,146C, which are formed at opposite side walls of an inner end portion of the latch plate 114 to be described in detail subsequently herein, are rockably inserted and supported.

The slider 112 is configured in a substantially turned U-shape as viewed in transverse cross-section, and is constructed such that the coil spring 113 is held at a left end thereof in a recess 139 formed between a substantially planner upper plate 137 and a lower portion 138 arranged on a lower wall of the upper plate 137 and configured in an L-shape as viewed in longitudinal cross-section. Formed on opposite side walls of a right end portion of the slider 112 are pressing portions 135B,135C for pressing legs 144B,144C of the latch plate 114 to be described in detail subsequently herein. Incidentally, the coil spring 113 is fixed at a right end thereof on the holding lug 145 of the bottom wall 11A.

The slider 112 is slidably supported with the lower portion 138 thereof loose-fitted in the opening 125 of the buckle base 111. When the tongue plate 105 is inserted into the buckle main body 110, the slider 112 is pressed by the leading end of the tongue plate 105 and is hence caused to slide rightward against biasing force of the coil spring 113, whereby the slider 112 presses the legs 144B,144C, which are arranged on lower ends of both side portions of the latch plate 114 to be described in detail subsequently herein, so that the latch plate 114 is caused to pivot counterclockwise (in a direction in which the latch plate 114 latches the tongue plate 105). When the tongue plate 105 is pulled out, on the other hand, the slider 112 is caused to return leftward under the biasing force of the coil spring 113.

Through an approximately central part of the latch plate 114, an opening 140 is formed such that the holder member 117 to be described in detail subsequently herein is partly inserted there. At a left end portion of the latch plate 114, a latch portion 141—which is to be inserted into the latching aperture 160 of the tongue plate 105 for the latching of the tongue plate 105 when the tongue plate 105 is inserted into the buckle main body 110—is formed extending downward. Formed between the latch portion 141 and the opening 140 is a support surface 142 which can be brought into contact with the lock pin 116 to be described in detail subsequently herein.

On the opposite side walls of the right end portion of the latch plate 114, the support portions 146A,146B are arranged extending from the opposite side walls. These support portions 146A,146B are rockably (pivotally) supported in the receiving notches 136B,136C of the side walls 111B,111C. Described specifically, the latch plate 114 rocks about the support portions 146B,146C as fulcrums and moves to the latching position, in which the latch plate 114 latches the tongue plate 105, or to an unlatching position, in which the latching of the tongue plate 105 is cancelled. On the opposite side walls of a right end portion of the latch plate 114, the legs 144B,144C are arranged extending downward. The slider 112 can be brought into contact at pressing portions 135B,135C thereof with these legs 144B,144C as mentioned above.

At a substantially central part of the right end portion of the latch plate 114, an abutting portion 143 is formed upright. Formed through a substantially central part of the abutting portion 143 is an opening 149. A shaft 147 to be described in detail subsequently herein can be inserted into the opening 149 and can also be pulled out of the opening 149.

The holder member 117 is provided with a main part 151, side walls 152B,152C, which are formed on opposite side walls of the main part 151, and the shaft 147 formed at a substantially central part of a right end portion of the main part 151.

The main part 151 is formed of a curved surface 154 arranged on a left outer side, an upper surface 155 formed in continuation with an upper part of the curved surface 154, a tilted surface 156 arranged in continuation with the upper surface 155, and a protuberance 158 extending downward from a substantially central part of the tilted surface 156.

Extending over the curved surface 154 and the upper surface 155, two ridges 151B,151C are formed such that they can be brought into contact with a face 132A of the spring holder 120 to be described in detail subsequently herein. The face 132A defines a left end of an opening 132 formed in a upper part of the spring holder 120.

The protuberance 158 is inserted in the opening 140 of the latch plate 114, and at end walls thereof as viewed in a transverse direction, is provided with claws 158B,158C which project outward in the transverse direction. Both of these claws 158B,158C are maintained in slidable engagement with the lower wall of the latch plate 114 at locations adjacent the opening 140. Namely, the holder member 117 is arranged such that the latch plate 114 is embraced by both of the claws 158B,158C.

Incidentally, the main part 151 is open at a surface (a lower surface) located opposite the upper surface 155, and is constructed such that the lock pin 116 inserted in the support apertures 157B,157C formed in the side walls 152B,152C, said support apertures 157B,157C being to be described in detail subsequently herein, are exposed through the lower surface.

Through substantially central parts of the side walls 152B,152C, the support apertures 157B,157C are opened in the form of elongated apertures tilted relative to the upper surface 155. Through these support apertures 157B,157C, the lock pin 116 is movably inserted. Opposite end portions of the lock pin 116 which extends through the support apertures 157B,157C are inserted in the slots 133B,133C of the buckle base 111 movably leftward and rightward. Formed on lower left end portions of the side walls 152B, 152C are abutting portions 159B,159C, with which tilted portions 163B,163C of the release button 118 can be brought into contact upon effecting a release of the tongue plate 105 by pressing the release button 118 as will be described in detail subsequently herein.

In a stage where the tongue plate 105 has not been inserted yet (see FIG. 13 and FIG. 16), the holder member 117 is biased leftward by the coil spring 115.

The lock pin 116 is therefore located on the side of the right edges of the support apertures 157B,157C and the slots 133B,133C. At this time, the support apertures 157B,157C are arranged in positions oblique relative to the slots 133B, 133C, in other words, at predetermined angles relative to the slots 133B,133C.

The shaft 147 is formed such that it has smaller diameter at a right end thereof than at a left end thereof. The coil spring 115 is loose-fitted on the shaft 147 so that owing to the arrangement of the shaft 147, the coil spring 115 is prevented from being bent or broken when it undergoes expansion and contraction. The small-diameter portion of the shaft 147 is dimensioned such that the small-diameter portion of the shaft 147 can freely extend back and forth through the opening 149 formed in the abutting portion 143 of the latch plate 114. On the other hand, the large-diameter portion of the shaft 147 is dimensioned greater than the diameter of the opening 149.

As has been described above, the shaft 147 freely extends back and forth through the opening 149 of the latch plate 114, and the claws 158B,158C are in slidable engagement with the latch plate 114 in such a way that the claws 158B,158C embrace the latch plate 114 therein. The holder member 117 can therefore slide on the latch plate 114 in response to a movement of the latch plate 14.

The spring holder 120 is arranged on the left side of the buckle base 111. On a substantially central part of the left end wall of the spring holder 120, a raised spring seat 128 is formed to fixedly hold the coil spring 119 at a right end portion thereof. Between a lower wall of the spring holder 120 and the bottom wall 11A of the buckle base 111, a space is formed as a mouth 153 to permit an insertion of the tongue plate 105.

The opening 132 is formed in an upper part of the spring holder 120. The opening 132 is constructed such that, when the tongue plate 105 has been brought into a latched state (see FIG. 14 and FIG. 15), the curved surface 154 and upper surface 155 of the holder member 117 penetrate under a portion which defines a left edge of the opening 32. When the tongue plate 105 has not been inserted yet in the buckle main body 110 (see FIG. 13 and FIG. 16), the holder member 117 is inserted at a left end portion thereof in the opening 132 such that the ridges 151B,151C formed on the curved surface 154 of the holder member 117 is in contact with the face 132A which defines the left edge of the opening 132. Incidentally, the portion which defines the left edge of the opening 132 serves as a lock control portion 131 which controls movements of the holder member 117.

The release button 118 is provided with an operating portion 161, which can be pressed by a user, and arms 162B,162C arranged on opposite sides of the operating portion 161 such that the arms 162B,162C extend out rightward horizontally. The release button 118 is also provided with tilted portions 163B,163C, which serve as drive portions for coming into contact with the abutting portions 159B,159C of the holder member 117 and causing the holder member 117 to the first position.

This release button 118 is slidably arranged on the side walls 11B,111C such that the beads 129B,129C formed on the inner walls of the right end portions of the arms 162B,162C are movably supported in the cranked slots 134B,134C formed in the side walls 111B,111C. Namely, this release button 118 is designed such that, when the release button 118 is pressed rightward to release the tongue plate 105 from the buckle main body 110, the advancement of the release button 118 is facilitated owing to the guiding of the beads 129B,129C by the cranked slots 134B,134C.

A raised spring seat 164 for holding the coil spring 119 at a left end portion thereof is formed on the inner end wall of the operating portion 161 at a substantially central part thereof. As the coil spring 119 held by the raised spring seat 164 is fixedly held at a right end portion thereof by the raised spring seat 128 of the spring holder 120, the release button 118 is biased normally leftward by the coil spring 119.

A description will next be made about a specific operation of the buckle assembly according to the second embodiment.

Figure 13:
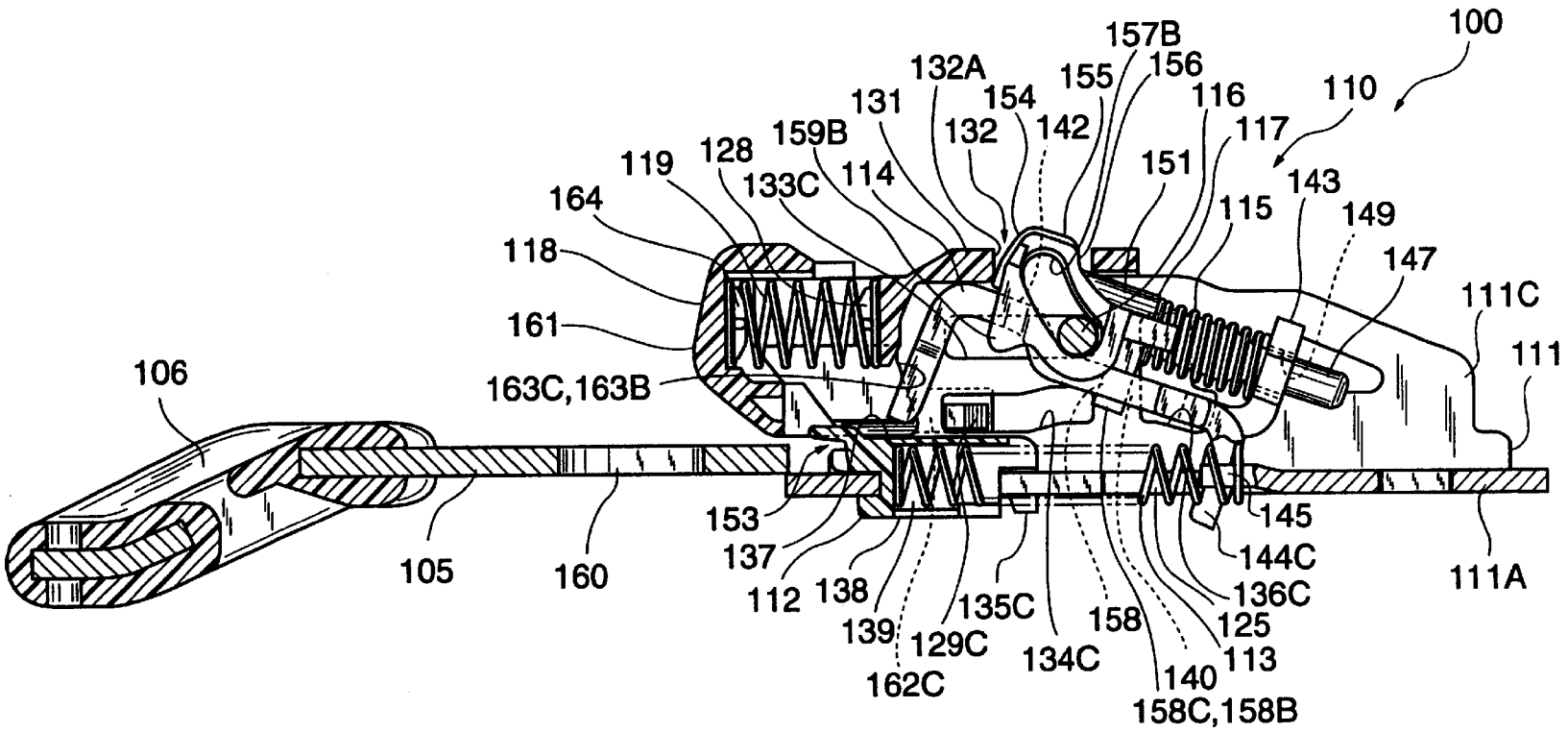
FIG. 13 is a cross-sectional view of the buckle assembly according to the second embodiment in a stage of an operation.
Figure 14:
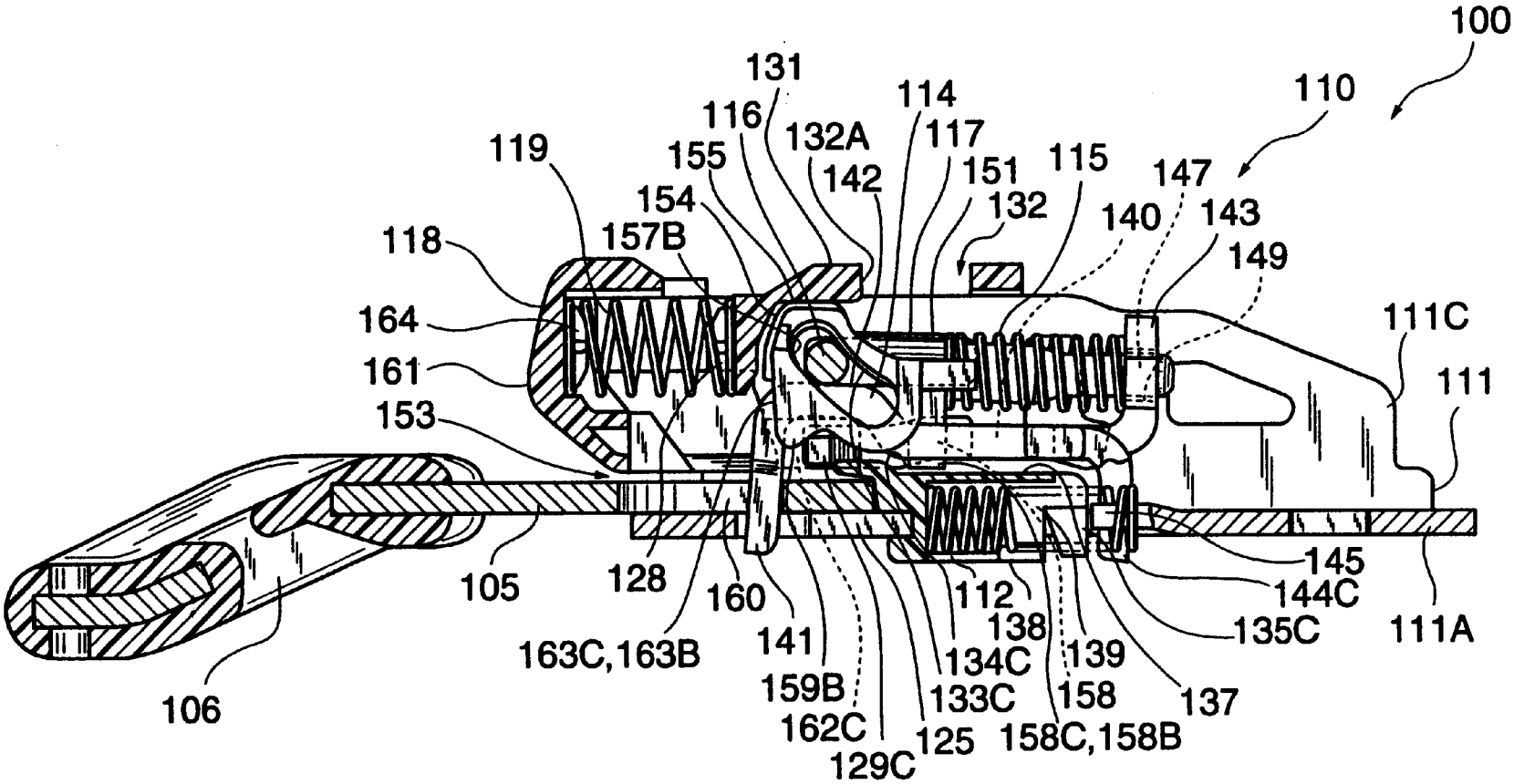
FIG. 14 is a cross-sectional view of the buckle assembly according to the second embodiment in another of the operation.
Figure 16:
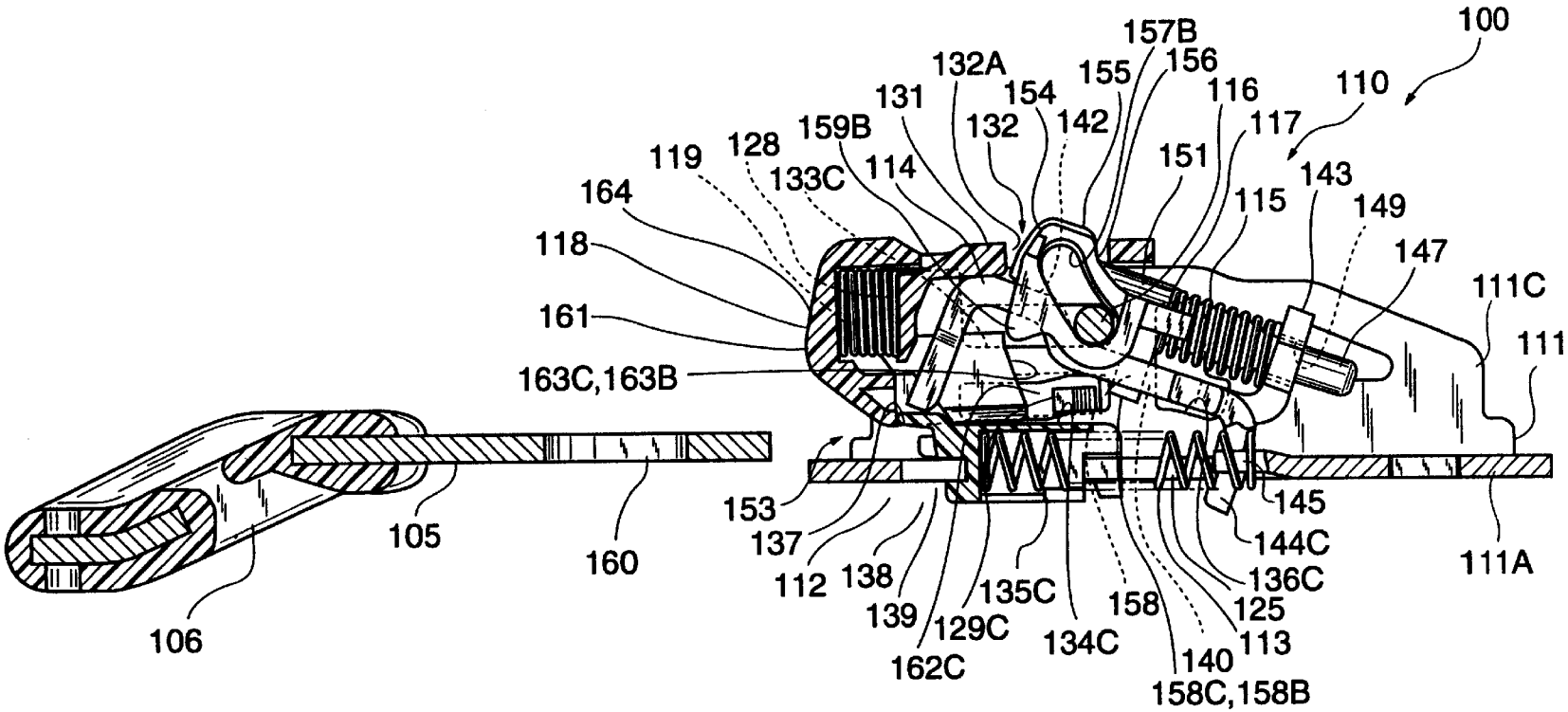
FIG. 16 is a cross-sectional view of the buckle assembly according to the second embodiment in a still further of the operation.
Figure 17:
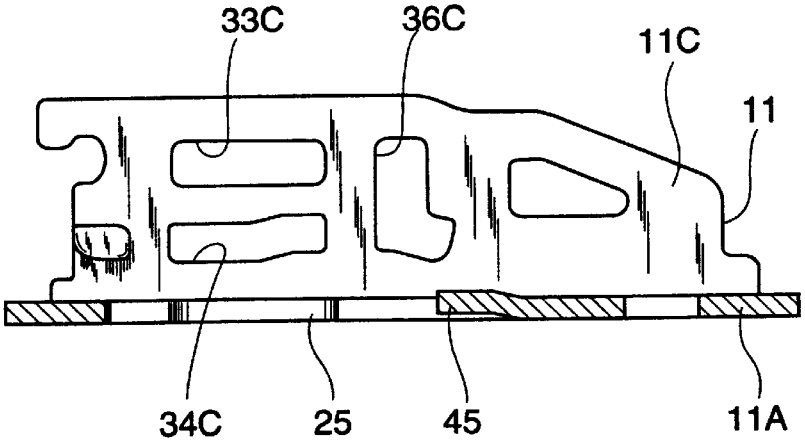
FIG. 17 is a cross-sectional view of a buckle base as an element in the buckle assembly of the second embodiment.

When the tongue plate 105 has not been inserted yet in the buckle main body 110, the slider 112 is placed on a left side by the biasing force of the coil spring 113 as illustrated in FIG. 13 and FIG. 16.

The holder member 117 is biased in an upper left direction by the coil spring 115, whereby the support apertures 157B,157C in the holder member 117 and the slots 133B, 133C in the side walls 111B,111C are arranged at a certain angle therebetween, respectively.

Further, the lock pin 116 is located at the right edges of the support apertures 157B,157C and also at the right edges of the slots 133B,133C. At this time, the latch plate 114 is allowed to retain under the biasing force of the coil spring 115 the state that the latch portion 41 is located in an upper position.

To latch the tongue plate 105 in the buckle main body 110, the tongue plate 105 is next inserted into the buckle main body 110 through the mouth 153. At this time, the leading end of the tongue plate 105 causes the slider 112 to move rightward so that the coil spring 113 is compressed. When the slider 112 comes into contact at the pressing portions 135B,135C thereof with the legs 144B,144C of the latch plate 114, the latch plate 114 begins to pivot toward the locking position (in a counterclockwise direction shown in the drawings) about the support portions 146B,146C as fulcrums.

Concurrently with the above motion, the holder member 117 begins to turn (move) in response to the pivotal motion of the latch plate 114 while compressing the coil spring 115 with the ridges 151B,151C formed on the curved surface 154 being maintained in contact with the lock control portion 131. Described specifically, the holder member 117 begins to undergo the above-described turning while being prevented from moving leftward by the lock control member 31. By this turning of the holder member 117, the lock pin 116 is pressed by upper edges of the support apertures 157B,157C, so that the lock pin 116 begins to move leftward in the slots 133B,133C of the side walls 111B,111C. Namely, the lock pin 116 undergoes a movement toward the retaining position by the cam action of the support apertures 157B, 157C and that of the slots 133B,133C.

When the tongue plate 105 is inserted, the latch plate 114 and the holder member 117 turn (move) further. The curved surface 154 of the holder member 117 is then caused to move beyond the lock control portion 131, whereby the holder member 117 penetrates under the lock control portion 131. As a result, the holder member 117 becomes movable leftward. As a consequence, the lock pin 116 moves to the left edges of the support apertures 157B,157C of the holder member 117. As the latching portion 141 of the latch plate 114 has already completed its engagement with the latching aperture 160 of the tongue plate 105 at the time point of the above-described penetration of the holder member 117, it is possible to prevent the lock pin 116 from being held between the latch plate 114 and the slots 133B,133C of the buckle base 111.

The leftward movement of the holder member 117 continues until the holder member 17 comes under the biasing force of the coil spring 115 into contact with the lock pin 116 moved to the left edges of the slots 133B,133C of the buckle base 111, and the latching is completed.

Incidentally, a force applied toward the unlatching position of the latch plate 114 (in the releasing direction) is borne by the support surface 142 of the latch plate 114, the lock pin 116, and the slots 133B,133C. The force is therefore divided, thereby making it possible to further enhance the reliability for strength.

Figure 15:
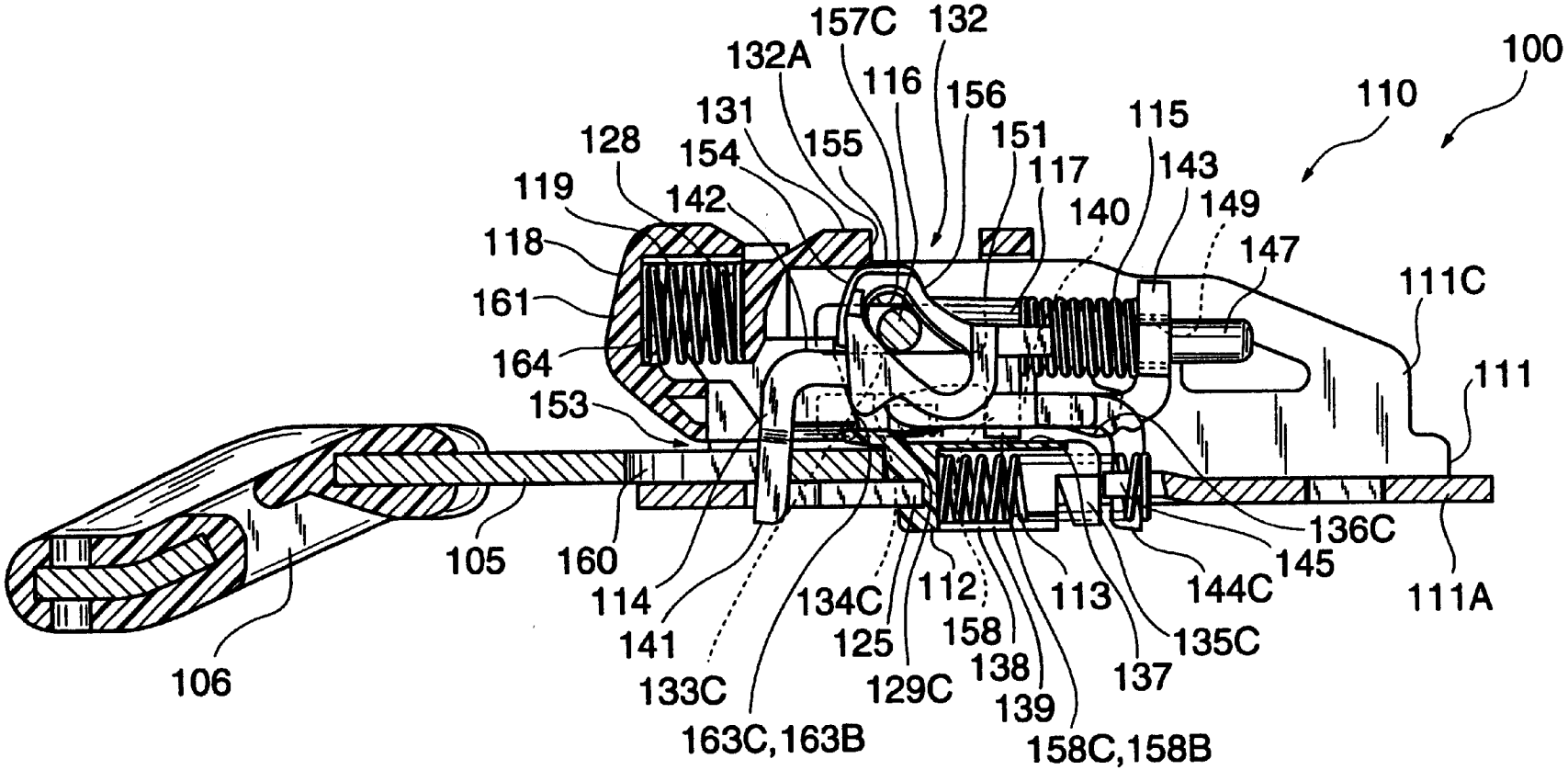
FIG. 15 is a cross-sectional view of the buckle assembly according to the second embodiment in a further of the operation.

Next, upon pulling the tongue plate 105 out of the buckle main body 110, the release button is pressed rightwards. The tilted portions 163B,163C of the release button 118 then come into contact with the abutting portions 159B,159C of the holder member 117 as shown in FIG. 15. When the release button 118 is pressed further, the holder member 117 begins to move rightward (in a substantially horizontal direction). The lock pin 116 is pressed via the holder member 117 and begins to move rightward (toward the non-retaining position), whereby the contact between the lock pin 116 and the support surface 142 of the latch plate 114 is canceled.

At this time point, the left edge of the upper surface 155 of the holder member 117 is still located on the lower surface of the lock control portion 131, so that the latch plate 114 is held by the holder member 117, remains in the latching position and has not moved to the unlatching position. When the release button 118 is pressed still further, the left edge of the upper surface 155 of the holder member 117 is caused to move beyond the lock control portion 131 and disengages from the lower surface of the lock control portion 131. As a result, it becomes possible for the holder member 117 to move upward in a substantially vertical direction.

During these movements, the release button 118 is caused to move with the beads 129B,129C guided by the cranked slots 134B,134C. Since the cranked slots 134B,134C are configured in a substantially crank form as mentioned above, the release button 118 is twisted or prized counterclockwise as viewed in FIG. 15.

Even if a foreign matter such as dirt or sugar-containing juice has penetrated to the inside of the buckle main body 110 and the sliding performance between the tilted portions 163B,163C of the release button 118 and the abutting portions 159B,159C of the holder member 117 has been deteriorated, it is still possible to surely achieve the movement of the holder member 117 toward the first position (in a substantially vertical direction) owing to the above-described twisting (prizing) of the release button 118.

By the above-described action of the release button 118, the holder member 117, as is illustrated in FIG. 16, moves at a stretch toward the first position, which corresponds to the unlatching position of the latch plate, by the biasing forces of the coil springs 15,13.

At the same time, the lock pin 116 is pressed by the lower edges of the support apertures 157B,157C of the holder member 117 and moves at a stretch to the retaining position (rightward) in the slots 133B,133C of the side walls 111B, 111C. Described specifically, the lock pin 116 is caused to move by the cam action of the support apertures 157B,157C and that of the slots 133B,133C. At this time, the lock pin 116 is supported only in the support apertures 157B,157C and the slots 133B,133C and is out of contact with the latch plate 114. The lock pin 116 therefore moves to a non-retaining position without stopping at an intermediate position.

Concurrently, the latch plate 114 pivots toward the unlatching position (in a clockwise direction) by the biasing force of the coil spring 115 about the support portions 146B,146C as fulcrums and moves to the unlatching position, so that the latching of the tongue plate 105 is canceled.

Figure 18:
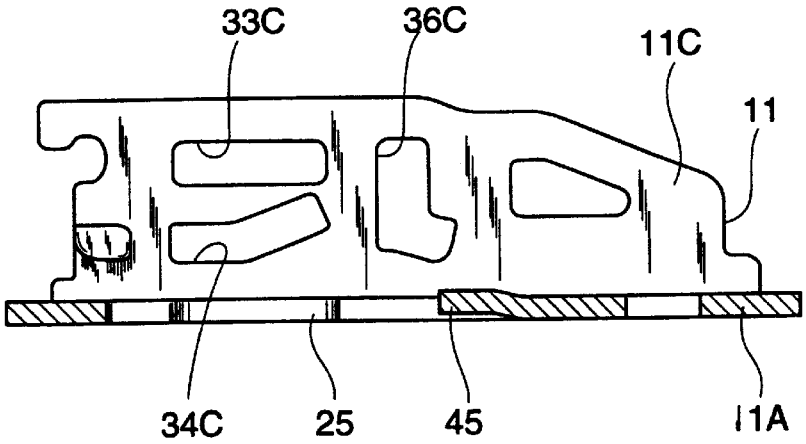
FIG. 18 is a cross-sectional view of a buckle base as an element in a buckle assembly according to a first modification of the second embodiment of the present invention.
Figure 19:
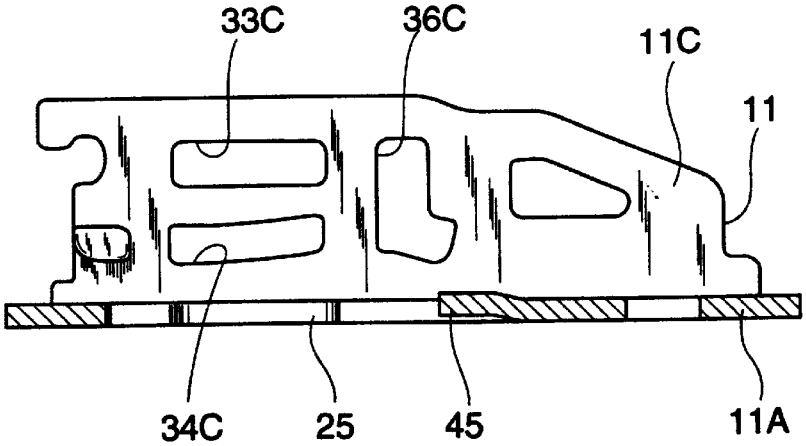
FIG. 19 is a cross-sectional view of a buckle base as an element in a buckle assembly according to a second modification of the second embodiment of the present invention.

In the second embodiment described above, the slots 134B,134C were configured in the substantially crank form. The slots 134B,134C are however not limited to such a crank form, and their shape can be modified, for example, into such a substantially L-shaped form that, as is illustrated in FIG. 18, the slots are bent upward at right parts thereof with respect to substantially central parts thereof as viewed in the horizontal direction or into such a curved form that, as is shown in FIG. 19, the slots are upwardly curved at right parts thereof. In essence, no particular limitation is imposed on the form of the slots 134B,134C insofar as they can induce a twisting or prizing motion of the release button 118 toward the unlatching position.

Provided that the release button 118 can be caused to undergo the same motion as that described above, guide ridges or the like may be arranged in place of the cranked slots 134B,134C to guide the beads 129B,129C.

What is claimed is:

1. A buckle assembly comprising a tongue plate and a buckle main body for releasably holding said tongue plate, wherein said buckle main body is provided with:

a base;

a lock control member supported on said base;

a latch plate supported on said base movably between a latching position, in which said latch plate is in latching engagement with said tongue plate, an unlatching position, in which said latch plate is out of latching engagement with said tongue plate;

an auxiliary lock member supported on said base movably between a retaining position, in which said auxiliary lock member retains said latch plate in said latching position, and a non-retaining position, in which said auxiliary lock member does not retain said latch plate in said latching position; and a holder member held on said latch plate movably relative to said latch plate and provided with a cam portion for controlling a motion of said auxiliary lock member, said holder member being capable of assuming a first position, in which said holder member is in contact with said lock control member on a side of a leading edge of said lock control member as viewed in a direction of insertion of said tongue plate such that under biasing force of a biasing member, said latch plate is retained in said unlatching position and said auxiliary lock member is brought to said non-retaining position, and a second position, in which said holder member is located on a side of said lock control member, where said tongue plate to be inserted is positioned, such that said auxiliary lock member is brought to said retaining position.

2. A buckle assembly according to claim 1, wherein said base is provided with guide paths for supporting said auxiliary lock member, and said guide paths extend substantially in parallel with said direction of insertion of said tongue plate.

3. A buckle assembly according to claim 2, wherein said cam portion is provided with slots, which permit extension of said auxiliary lock member therethrough and which, when said holder member has assumed said first position, extend in intersecting directions relative to the corresponding guide paths in said base.

4. A buckle assembly according to claim 3, wherein said slots are formed such that said slots intersect the corresponding guide paths in said base irrespective of the position of said holder member.

5. A buckle assembly according to claim 1, wherein said auxiliary lock member is a pin.

6. A buckle assembly according to claim 1, wherein said holder member is held movably relative to said latch plate in said latched position thereof in a direction substantially parallel with said direction of insertion of said tongue plate.

7. A buckle assembly according to claim 1, wherein said buckle base is provided with a bottom wall and a pair of side walls extending upright from said bottom wall; and said buckle assembly is provided further with a release button for bringing said holder member from said second position to said first position when pressed and also with a control portion for controlling said release button at a leading end thereof, as viewed in a pressing direction of said release button, in a direction away from said bottom wall of said buckle base when a pressed stroke of said release button has increased.

8. A buckle assembly according to claim 7, wherein said control portion is formed in said buckle base.

9. A buckle assembly according to claim 8, wherein said control portion comprises slots formed in said side walls of said buckle base, respectively, such that said slots are maintained in engagement with engaging portions arranged on a leading end of said release button as viewed in a pressing direction of said release button.

10. A buckle assembly according to claim 9, wherein each of said slots comprises a first part extending in said pressing direction of said release button, a second part extending substantially in parallel with said first part at a position more apart from said bottom wall of said buckle base on a still inner side of an inner end of said first part as viewed in said pressing direction of said release button, and a connecting part connecting said first part and said second part together.

11. A buckle assembly according to claim 9, wherein each of said slots comprises a first part extending in said pressing direction of said release button and a second part extending from an inner end of said first part in said pressing direction of said release button and in a direction away from said bottom wall of said buckle base.

12. A buckle assembly according to claim 1, wherein said assembly is provided further with a release button for bringing said holder member from said second position to said first position, a biasing member for biasing said release button and a spring holder arranged on said buckle base for supporting said biasing means thereon, and said lock control member is formed at a part of said spring holder.

* * * * *